US010845099B2

(12) United States Patent
Nishiyama et al.

(10) Patent No.: US 10,845,099 B2
(45) Date of Patent: Nov. 24, 2020

(54) REFRIGERATION CYCLE APPARATUS WITH PATH SWITCHING CIRCUIT

(71) Applicant: Mitsubishi Electric Corporation, Tokyo (JP)

(72) Inventors: Takumi Nishiyama, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/068,388

(22) PCT Filed: Feb. 22, 2016

(86) PCT No.: PCT/JP2016/054992
§ 371 (c)(1),
(2) Date: Jul. 6, 2018

(87) PCT Pub. No.: WO2017/145219
PCT Pub. Date: Aug. 31, 2017

(65) Prior Publication Data

US 2019/0024951 A1 Jan. 24, 2019

(51) Int. Cl.
*F25B 13/00* (2006.01)
*F25B 39/02* (2006.01)
(Continued)

(52) U.S. Cl.
CPC ..... *F25B 13/00* (2013.01); *F25B 39/028* (2013.01); *F25B 41/04* (2013.01);
(Continued)

(58) Field of Classification Search
CPC ..... F25B 41/04; F25B 2313/0276; F25B 2313/02732; F25B 2313/0272;
(Continued)

(56) References Cited

U.S. PATENT DOCUMENTS 5,634,352 A * 6/1997 Nagai ..... F16K 11/065 62/324.6
2013/0327509 A1 12/2013 Michitsuji
(Continued)

FOREIGN PATENT DOCUMENTS

EP 1031801 A2 8/2000
JP S60-093277 A 5/1985
(Continued)

OTHER PUBLICATIONS

International Search Report ("ISR") dated May 17, 2016 issued in corresponding International patent application No. PCT/JP2016/054992 (with English translation).
(Continued)

*Primary Examiner* — Steve S Tanenbaum
(74) *Attorney, Agent, or Firm* — Posz Law Group, PLC

(57) ABSTRACT

A refrigeration cycle apparatus includes a heat exchanger, and a flow switching circuit configured to switch the heat exchanger to act as any one of an evaporator and a condenser, the flow switching circuit is configured to allow refrigerant to flow into the heat exchanger in the same direction both in a case where the heat exchanger acts as an evaporator and in a case where the heat exchanger acts as a condenser, the heat exchanger includes a path switching circuit including a plurality of paths, and the path switching circuit is configured to switch an order of the plurality of paths through which refrigerant flows between an order of the plurality of paths in the case where the heat exchanger acts as an evaporator and another order of the plurality of paths in the case where the heat exchanger acts as a condenser.

14 Claims, 12 Drawing Sheets

(51) Int. Cl.

| | |
|---|---|
| ***F25B 41/04*** | (2006.01) |
| ***F25B 5/00*** | (2006.01) |
| ***F25B 39/00*** | (2006.01) |
| ***F25B 39/04*** | (2006.01) |

(52) U.S. Cl.
CPC ..... *F25B 2313/0233* (2013.01); *F25B 2313/0272* (2013.01); *F25B 2313/0276* (2013.01); *F25B 2313/02732* (2013.01); *F25B 2313/02741* (2013.01); *F25B 2313/02742* (2013.01); *F25B 2400/23* (2013.01)

(58) Field of Classification Search
CPC .. F25B 2313/02741; F25B 2313/02742; F25B 2313/0233
USPC ..... 62/324.6
See application file for complete search history.

(56) References Cited

U.S. PATENT DOCUMENTS

2015/0276280 A1* 10/2015 Furui ..... F25B 13/00 62/160
2016/0138839 A1* 5/2016 Suhara ..... F24F 13/30 62/160

FOREIGN PATENT DOCUMENTS

| | | | | | |
|---|---|---|---|---|---|
| JP | S63-125756 | U1 | | 8/1988 | |
| JP | H07-324844 | A | | 12/1995 | |
| JP | H08-170864 | A | | 7/1996 | |
| JP | H08-189724 | A | | 7/1996 | |
| JP | H10-170081 | A | | 6/1998 | |
| JP | H10-252908 | A | | 9/1998 | |
| JP | 2000-249479 | A | | 9/2000 | |
| JP | 2001-099510 | A | | 4/2001 | |
| JP | 2001-336859 | A | | 12/2001 | |
| JP | 2012-172938 | A | | 9/2012 | |
| JP | 2014-215017 | A | | 11/2014 | |
| JP | 2014215017 | A | * | 11/2014 | ..... F24F 13/30 |
| WO | 2012/147336 | A1 | | 11/2012 | |

OTHER PUBLICATIONS

Office action dated Jun. 11, 2019 issued in corresponding JP patent application No. 2018-501409 (and English translation thereof).

* cited by examiner

REFRIGERATION CYCLE APPARATUS WITH PATH SWITCHING CIRCUIT

CROSS REFERENCE TO RELATED APPLICATION

This application is a U.S. national stage application of PCT/JP2016/054992 filed on Feb. 22, 2016, the contents of which are incorporated herein by reference.

TECHNICAL FIELD

The present invention relates to a refrigeration cycle apparatus including a counter flow type heat exchanger.

BACKGROUND ART

In a conventional refrigeration cycle apparatus including a flow switching circuit capable of switching a cooling operation and a heating operation, a refrigeration cycle apparatus adopting a configuration of a heat exchanger in which a flowing direction of refrigerant and a flowing direction of air for heat exchange are opposite is known (for example, see Patent Literature 1).

CITATION LIST

Patent Literature

Patent Literature 1: Japanese Unexamined Patent Application Publication No. 8-189724

SUMMARY OF INVENTION

Technical Problem

In such a counter flow type heat exchanger, as a flowing direction of refrigerant and a flowing direction of air for heat exchange are opposite, by keeping a temperature difference between the air and the refrigerant small at all times in a heat exchange process, heat exchange efficiency improves. Then, in the counter flow type heat exchanger, the number of paths of a heat transfer tube need to be increased to reduce pressure loss of the refrigerant aiming at further improvement of the heat exchange efficiency.

However, because a refrigerant flow rate per path declines due to the increased number of paths of the heat exchanger, there is a problem in that liquefaction tends to occur during condensation in particular and heat transfer performance of the refrigerant and the air declines.

The present invention is implemented in consideration of the problem described above, and an object is to provide a refrigeration cycle apparatus that further improves a heat transfer performance of a heat exchanger that exchanges heat as a counter flow type.

Solution to Problem

A refrigeration cycle apparatus according to an embodiment of the present invention includes a heat exchanger, and a flow switching circuit configured to switch the heat exchanger to act as any one of an evaporator and a condenser, the flow switching circuit is configured to allow refrigerant to flow into the heat exchanger in the same direction both in a case where the heat exchanger acts as an evaporator and in a case where the heat exchanger acts as a condenser, the heat exchanger includes a path switching circuit including a plurality of paths, and the path switching circuit is configured to switch an order of the plurality of paths through which refrigerant flows between an order of the plurality of paths in the case where the heat exchanger acts as an evaporator and another order of the plurality of paths in the case where the heat exchanger acts as a condenser.

Advantageous Effects of Invention

With the refrigeration cycle apparatus according to an embodiment of the present invention, because an order of a plurality of paths through which refrigerant flows in a counter flow type heat exchanger is switched in the case of a cooling operation and in the case of a heating operation and the number of paths is changed depending on change of a volume of refrigerant due to phase change of the refrigerant, pressure loss can be reduced, and heat exchange efficiency can be improved further.

DESCRIPTION OF EMBODIMENTS

A refrigeration cycle apparatus according to the present invention will be described hereinafter with reference to the drawings.

Note that configurations, operations, and other features described below are merely examples, and the refrigeration cycle apparatus according to the present invention is not limited to the case of such configurations, operations, and other features. In addition, in the individual drawings, for the same or similar components, the same reference signs are attached or attachment of the reference signs is omitted. Furthermore, for detailed structures, illustrations are appropriately simplified or omitted. In addition, redundant or similar descriptions are appropriately simplified or omitted.

Embodiment 1

The refrigeration cycle apparatus according to Embodiment 1 will be described.

<Configuration of Refrigeration Cycle Apparatus 100>

Figure 1:
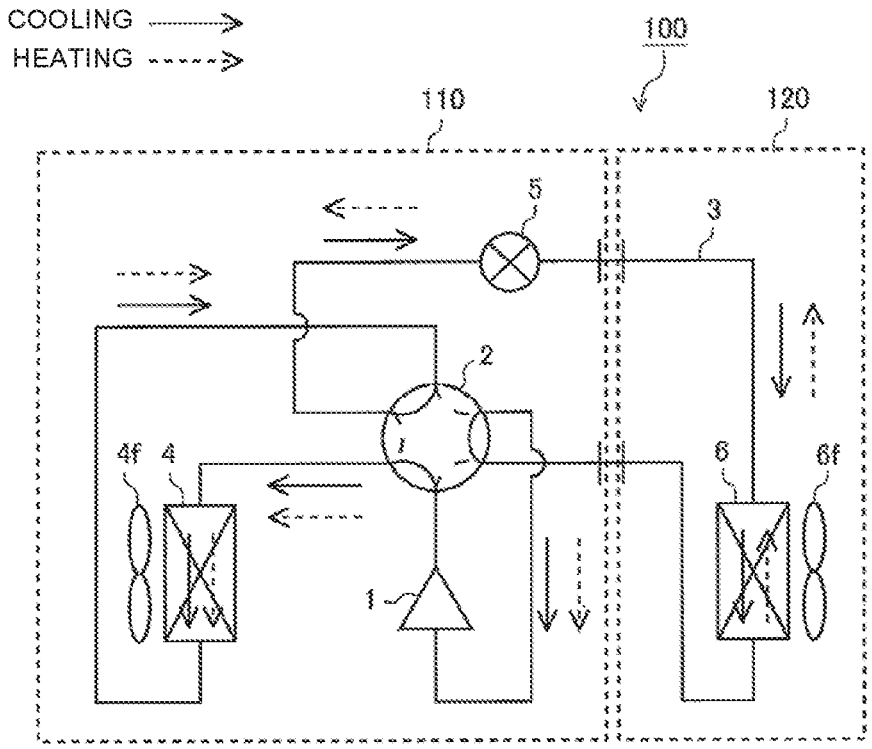
FIG. 1 is a configuration diagram of a refrigeration cycle apparatus 100 according to Embodiment 1.

FIG. 1 is a configuration diagram of a refrigeration cycle apparatus 100 according to Embodiment 1.

The refrigeration cycle apparatus 100 includes an outdoor unit 110 and an indoor unit 120. The outdoor unit 110 and the indoor unit 120 are connected to each other through refrigerant pipes 3. In the refrigeration cycle apparatus 100, a refrigerant circuit is formed by the outdoor unit 110, the indoor unit 120, and the refrigerant pipes.

The refrigerant circuit (corresponding to a flow switching circuit of the present invention) includes a compressor 1, a six-way valve 2, an outdoor heat exchanger 4, an expansion valve 5, and an indoor heat exchanger 6. The compressor 1, the six-way valve 2, the outdoor heat exchanger 4, and the expansion valve 5 are housed in the outdoor unit 110. On the other hand, the indoor heat exchanger 6 is housed in the indoor unit 120. In the vicinity of the outdoor heat exchanger 4, an outdoor fan 4*f* configured to supply air for heat exchange to the outdoor heat exchanger 4 is installed. In addition, in the vicinity of the indoor heat exchanger 6, an indoor fan 6*f* configured to supply air for heat exchange to the indoor heat exchanger 6 is installed.

Note that the above-described configuration includes the minimum components capable of achieving the present invention, and a gas-liquid branching unit, a receiver, an accumulator, a high-low pressure heat exchanger, and other components may be connected to form the refrigeration cycle apparatus 100.

For refrigerant used in the refrigeration cycle apparatus 100, not only single component refrigerant but also an azeotropic, near-azeotropic, or zeotropic refrigerant mixture in which at least two kinds of refrigerant are mixed can be adopted. Note that the refrigerant can be mixed with an optional mixing ratio of the refrigerant such as R32, HFO1234yf, HFO1234ze(E), R125, HFO1123, R134a, and R290.

<Configuration of Six-Way Valve 2>

Figure 2:
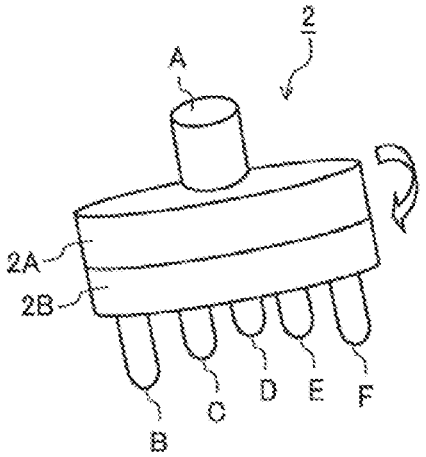
FIG. 2 is a perspective view of a six-way valve according to Embodiment 1.

FIG. 2 is a perspective view of the six-way valve according to Embodiment 1.

Figure 3:
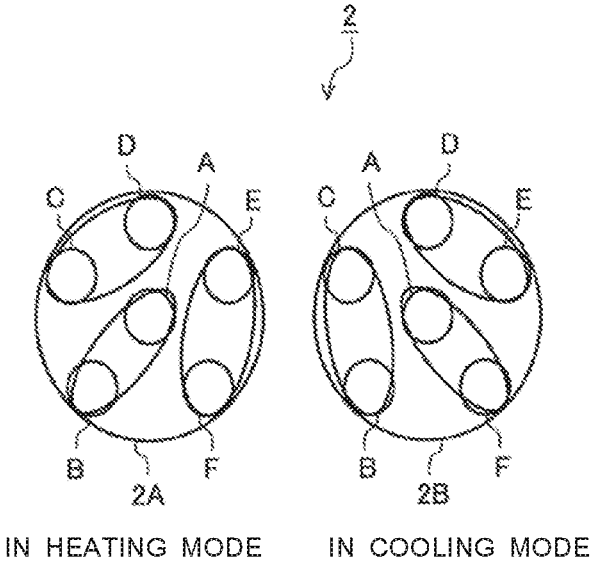
FIG. 3 is a switching illustration diagram of the six-way valve according to Embodiment 1.

FIG. 3 is a switching illustration diagram of the six-way valve according to Embodiment 1.

The six-way valve 2 includes six ports A to F as illustrated in FIG. 2. Then, the six-way valve 2 is constituted of a substrate unit 2B to which the five ports B to F are connected and a rotary unit 2A turnably attached to the substrate unit 2B. As the rotary unit 2A rotates against the substrate unit 2B, as illustrated in FIG. 3, adjacent ports are reconnected with each other to switch a heating mode and a cooling mode of the refrigeration cycle apparatus 100.

Note that, while a rotary type six-way valve is described in FIGS. 2 and 3, a slide type valve or another valve may be adopted.

<Operation of Refrigeration Cycle Apparatus 100>

Next, an operation of the refrigeration cycle apparatus 100 will be described. The refrigeration cycle apparatus 100 can achieve a cooling operation and a heating operation by switching flow paths of the six-way valve 2.

In the refrigerant circuit during the cooling operation, a refrigeration cycle is formed in a state in which the flow paths of the six-way valve 2 are switched to solid lines illustrated in FIG. 1. In the case of the cooling operation, the refrigerant sent out from the compressor 1 flows in order of the six-way valve 2, the outdoor heat exchanger 4, the six-way valve 2, the expansion valve 5, the indoor heat exchanger 6, the six-way valve 2, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the six-way valve 2 are switched to broken lines illustrated in FIG. 1. In the case of the heating operation, the refrigerant sent out from the compressor 1 flows in the order of the six-way valve 2, the indoor heat exchanger 6, the expansion valve 5, the six-way valve 2, the outdoor heat exchanger 4, the six-way valve 2, and the compressor 1. At the time, the indoor heat exchanger 6 acts as a condenser, and the outdoor heat exchanger 4 acts as an evaporator.

By attaining such a refrigerant circuit, an inflow direction of the refrigerant to each path of the outdoor heat exchanger 4 becomes the same in the case of the cooling operation and in the case of the heating operation.

<Configuration of Outdoor Heat Exchanger 4>

Figure 4:
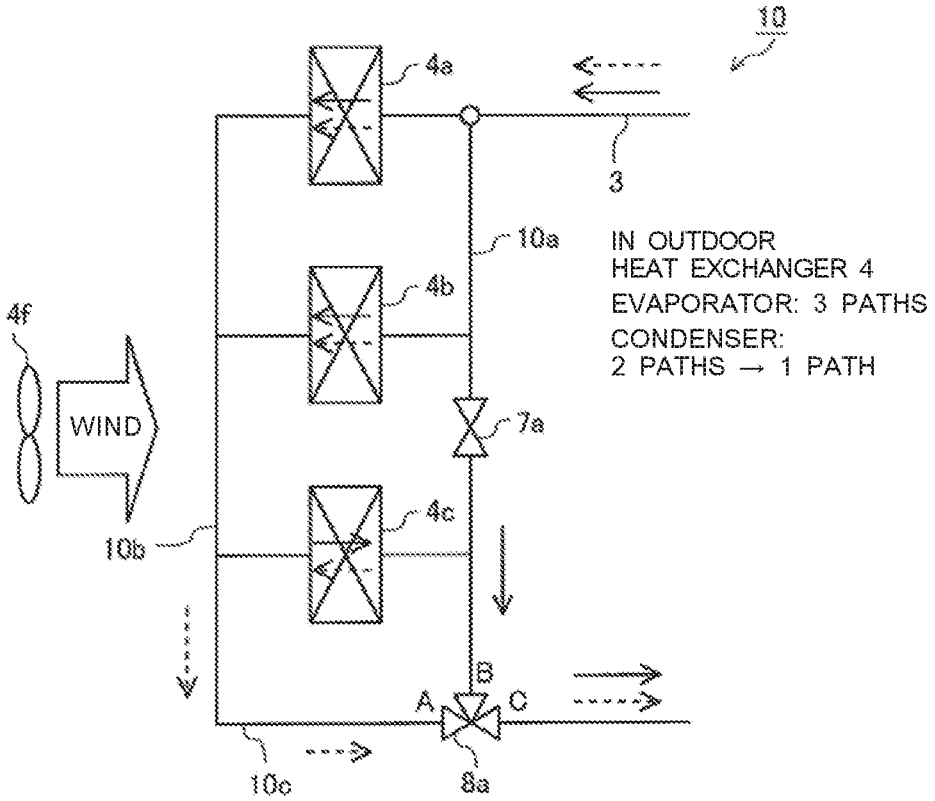
FIG. 4 is a configuration diagram of a path switching circuit 10 according to Embodiment 1.

FIG. 4 is a configuration diagram of a path switching circuit 10 according to Embodiment 1.

As illustrated in FIG. 4, the outdoor heat exchanger 4 includes three paths for example, and is constituted of the path switching circuit 10. To the respective three paths, a first heat exchange unit 4*a*, a second heat exchange unit 4*b*, and a third heat exchange unit 4*c* are connected in parallel.

The path switching circuit 10 is constituted of a first flow path 10*a* connecting each refrigerant pipe on a leeward side of the first heat exchange unit 4*a*, the second heat exchange unit 4*b*, and the third heat exchange unit 4*c*, a second flow path 10*b* connecting each refrigerant pipe on a windward side of the first heat exchange unit 4*a*, the second heat exchange unit 4*b*, and the third heat exchange unit 4*c*, and a third flow path 10*c* connecting the first flow path 10*a* and the second flow path 10*b* and bypassing the third heat exchange unit 4*c*.

Between the second heat exchange unit 4*b* and the third heat exchange unit 4*c* in the first flow path, a first on-off valve 7*a* is provided. In addition, at a connecting position of the first flow path 10*a* and the third flow path 10*c*, a first three-way valve 8*a* including three ports (ports A to C) is provided.

Note that, in a vertical direction, it is desirable to position the third heat exchange unit 4*c* below the first heat exchange unit 4*a* and the second heat exchange unit 4*b*.

In addition, for the outdoor heat exchanger 4 and the indoor heat exchanger 6, a plate fin heat exchanger, a fin and tube heat exchanger, a flat tube (perforated pipe) heat exchanger, or another heat exchanger can be adopted.

Note that, while the path switching circuit 10 of the outdoor heat exchanger 4 is illustrated as an example, the indoor heat exchanger 6 may be in a similar path configuration.

<Flow of Refrigerant in Path Switching Circuit 10>

In the case of the cooling operation, the refrigerant flows as the solid lines to the path switching circuit 10 of the outdoor heat exchanger 4. That is, by closing the first on-off valve 7*a*, high-pressure gas refrigerant flowing into the path switching circuit 10 flows into the first heat exchange unit 4*a* and the second heat exchange unit 4*b* first and is condensed. The refrigerant flowing out of the first heat exchange unit 4*a* and the second heat exchange unit 4*b* flows into the third heat exchange unit 4*c*, by closing the port A of the first three-way valve 8*a* and opening the port B and the port C, and becomes liquid refrigerant. Then, the liquid refrigerant is supplied to the indoor heat exchanger 6. At the time, the refrigerant of low quality flows from the first heat exchange unit 4*a* and the second heat exchange unit 4*b* to the third heat exchange unit 4*c* at a lower position.

In the case of the heating operation, the refrigerant flows as the broken lines to the path switching circuit 10 of the outdoor heat exchanger 4. That is, by opening the first on-off valve 7*a*, low-pressure liquid refrigerant flowing into the path switching circuit 10 flows into the first heat exchange unit 4*a*, the second heat exchange unit 4*b*, and the third heat exchange unit 4*c* in parallel and evaporates. The gas refrigerant flowing out of each heat exchange unit is sucked by the compressor 1, by closing the port B of the first three-way valve 8*a* and opening the port A and the port C.

<Effects>

In the refrigeration cycle apparatus 100 according to Embodiment 1, in the outdoor heat exchanger 4, the refrigerant flows in from the same direction in the case of the cooling operation and in the case of the heating operation. Consequently, the air for the heat exchange supplied from the outdoor fan 4*f* and the refrigerant flowing through a heat transfer tube of the outdoor heat exchanger 4 exchange heat as counter flows. Consequently, by keeping a temperature difference between the air and the refrigerant small at all times in a heat exchange process compared to a parallel flow, heat exchange efficiency is improved, a high and low pressure difference of the refrigeration cycle apparatus 100 is maintained small, and input of the compressor 1 can be reduced. Note that improvement of the heat exchange efficiency by the counter flows becomes remarkable when a zeotropic refrigerant mixture, which has a temperature glide during the heat exchange, is used. In addition, by attaining the counter flows, an evaporating temperature in the case of the heating operation is maintained high, and a frosting amount can be reduced. Furthermore, by positioning the third heat exchange unit 4*c* below the first heat exchange unit 4*a* and the second heat exchange unit 4*b* in the vertical direction, the condensed liquid refrigerant can be guided in a gravity direction, and influence of a liquid head can be reduced.

In addition, in the path switching circuit 10 according to Embodiment 1, the order of the plurality of paths through which the refrigerant flows in the outdoor heat exchanger 4 is switched in the case of the cooling operation and in the case of the heating operation, and only when the outdoor heat exchanger 4 acts as a condenser, the number of inflow paths is two and the number of outflow paths is changed to one. Consequently, as the number of the paths is reduced depending on decrease of a volume of the refrigerant due to phase change of the refrigerant, pressure loss can be reduced and the heat exchange efficiency can be improved further.

In addition, when the outdoor heat exchanger 4 acts as an evaporator in the case of the heating operation, by making the refrigerant flow in the same direction to each path, hot gas generated when a reverse cycle is formed flows into a refrigerant inflow unit with a largest frosting amount of each path, so that a defrosting operation can be efficiently performed. Note that the improvement of defrosting efficiency becomes remarkable in the case of using the zeotropic refrigerant mixture, which has a low temperature on an entrance side of each path.

Next, modifications of the refrigeration cycle apparatus 100 according to Embodiment 1 will be described.

[Modification 1 of Refrigeration Cycle Apparatus 100]

Figure 5:
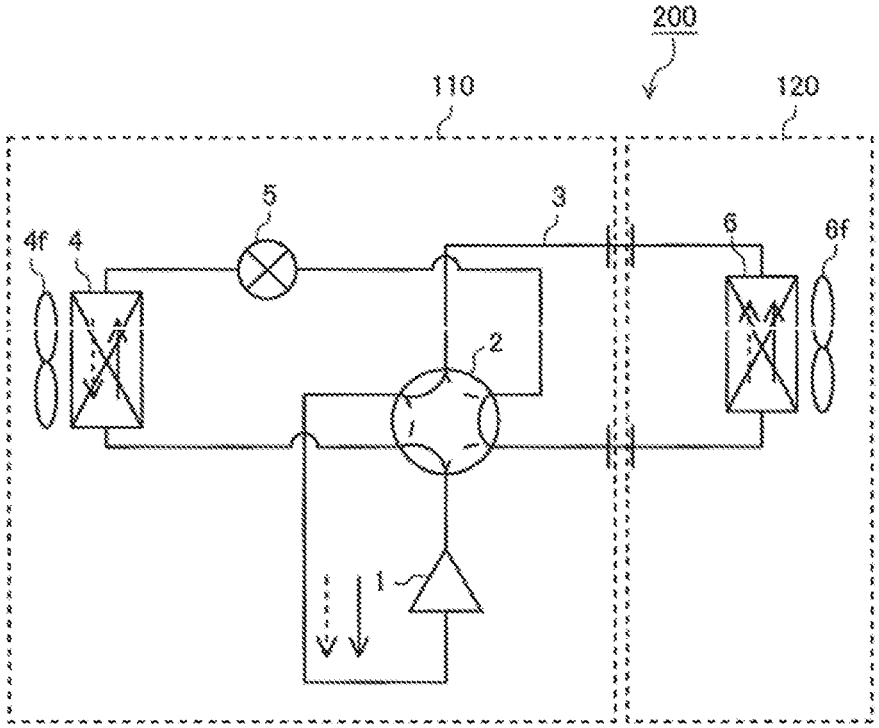
FIG. 5 is a configuration diagram illustrating a modification 1 of the refrigeration cycle apparatus 100 according to Embodiment 1.

FIG. 5 is a configuration diagram illustrating a modification 1 of the refrigeration cycle apparatus 100 according to Embodiment 1.

A refrigeration cycle apparatus 200 according to the modification 1 is different from the refrigeration cycle apparatus 100 according to Embodiment 1 at a point that the direction of the refrigerant flowing through the indoor heat exchanger 6 is made the same in the case of the cooling operation and in the case of the heating operation to attain the counter flow.

<Configuration of Refrigeration Cycle Apparatus 200>

A refrigerant circuit (corresponding to the flow switching circuit of the present invention) of the refrigeration cycle apparatus 200 includes the compressor 1, the six-way valve 2, the outdoor heat exchanger 4, the expansion valve 5, and the indoor heat exchanger 6, similarly to the refrigeration cycle apparatus 100. The compressor 1, the six-way valve 2, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 200>

Next, an operation of the refrigeration cycle apparatus 200 will be described. The refrigeration cycle apparatus 100 can achieve the cooling operation and the heating operation by switching the flow paths of the six-way valve 2.

In the refrigerant circuit during the cooling operation, the refrigeration cycle is formed in the state in which the flow paths of the six-way valve 2 are switched to solid lines illustrated in FIG. 5. In the case of the cooling operation, the refrigerant sent out from the compressor 1 flows in the order of the six-way valve 2, the outdoor heat exchanger 4, the expansion valve 5, the six-way valve 2, the indoor heat exchanger 6, the six-way valve 2, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the six-way valve 2 are switched to broken lines illustrated in FIG. 5. In the case of the heating operation, the refrigerant sent out from the compressor 1 flows in the order of the six-way valve 2, the indoor heat exchanger 6, the six-way valve 2, the expansion valve 5, the outdoor heat exchanger 4, the six-way valve 2, and the compressor 1. At the time, the indoor heat exchanger 6 acts as a condenser, and the outdoor heat exchanger 4 acts as an evaporator.

By attaining such a refrigerant circuit, the inflow direction of the refrigerant to the indoor heat exchanger 6 becomes the same in the case of the cooling operation and in the case of the heating operation.

<Effects>

In the refrigeration cycle apparatus 200 according to the modification 1 of Embodiment 1, the inflow direction of the refrigerant to the indoor heat exchanger 6 becomes the same in the case of the cooling operation and in the case of the heating operation to attain the counter flow against the inflow direction of the air, so that, in the indoor heat exchanger 6, similar effects as the outdoor heat exchanger 4 according to Embodiment 1 described above can be obtained.

[Modification 2 of Refrigeration Cycle Apparatus 100]

Figure 6:
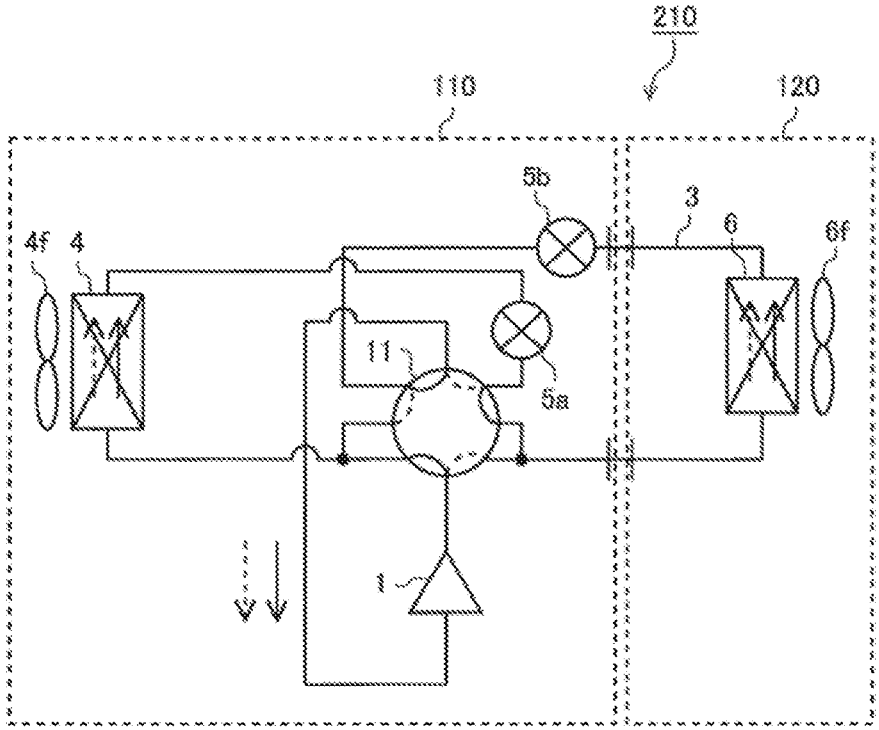
FIG. 6 is a configuration diagram illustrating a modification 2 of the refrigeration cycle apparatus 100 according to Embodiment 1.

FIG. 6 is a configuration diagram illustrating a modification 2 of the refrigeration cycle apparatus 100 according to Embodiment 1.

A refrigeration cycle apparatus 210 according to the modification 2 is different from the refrigeration cycle apparatus 100 according to Embodiment 1 at the point that the direction of the refrigerant flowing through each of the outdoor heat exchanger 4 and the indoor heat exchanger 6 is made the same in the case of the cooling operation and in the case of the heating operation to attain the counter flows.

<Configuration of Refrigeration Cycle Apparatus 210>

A refrigerant circuit (corresponding to the flow switching circuit of the present invention) of the refrigeration cycle apparatus 210 includes the compressor 1, an eight-way valve 11, the outdoor heat exchanger 4, a first expansion valve 5*a*, a second expansion valve 5*b*, and the indoor heat exchanger 6. The compressor 1, the eight-way valve 11, the outdoor heat exchanger 4, the first expansion valve 5*a*, and the second expansion valve 5*b* are housed in the outdoor unit 110. On the other hand, the indoor heat exchanger 6 is housed in the indoor unit 120.

<Operation of Refrigeration Cycle Apparatus 210>

Next, an operation of the refrigeration cycle apparatus 210 will be described. The refrigeration cycle apparatus 210 can achieve the cooling operation and the heating operation by switching the flow paths of the eight-way valve 11.

In the refrigerant circuit during the cooling operation, the refrigeration cycle is formed in the state in which the flow paths of the eight-way valve 11 are switched to solid lines illustrated in FIG. 6. In the case of the cooling operation, the refrigerant sent out from the compressor 1 flows in the order of the eight-way valve 11, the outdoor heat exchanger 4, the first expansion valve 5*a*, the eight-way valve 11, the indoor heat exchanger 6, the second expansion valve 5*b*, the eight-way valve 11, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the eight-way valve 11 are switched to broken lines illustrated in FIG. 6. In the case of the heating operation, the refrigerant sent out from the compressor 1 flows in the order of the eight-way valve 11, the indoor heat exchanger 6, the second expansion valve 5*b*, the eight-way valve 11, the outdoor heat exchanger 4, the first expansion valve 5*a*, the eight-way valve 11, and the compressor 1. At the time, the indoor heat exchanger 6 acts as a condenser, and the outdoor heat exchanger 4 acts as an evaporator.

By attaining such a refrigerant circuit, the inflow direction of the refrigerant to each of the outdoor heat exchanger 4 and the indoor heat exchanger 6 becomes the same in the case of the cooling operation and in the case of the heating operation.

<Effects>

In the refrigeration cycle apparatus 210 according to the modification 2 of Embodiment 1, the inflow direction of the refrigerant to each of the outdoor heat exchanger 4 and the indoor heat exchanger 6 becomes the same in the case of the cooling operation and in the case of the heating operation to attain the counter flows against the inflow directions of the air, so that, in both of the outdoor heat exchanger 4 and the indoor heat exchanger 6, the similar effects as the outdoor heat exchanger 4 according to Embodiment 1 described above can be obtained.

[Modification 3 of Refrigeration Cycle Apparatus 100]

Figure 7:
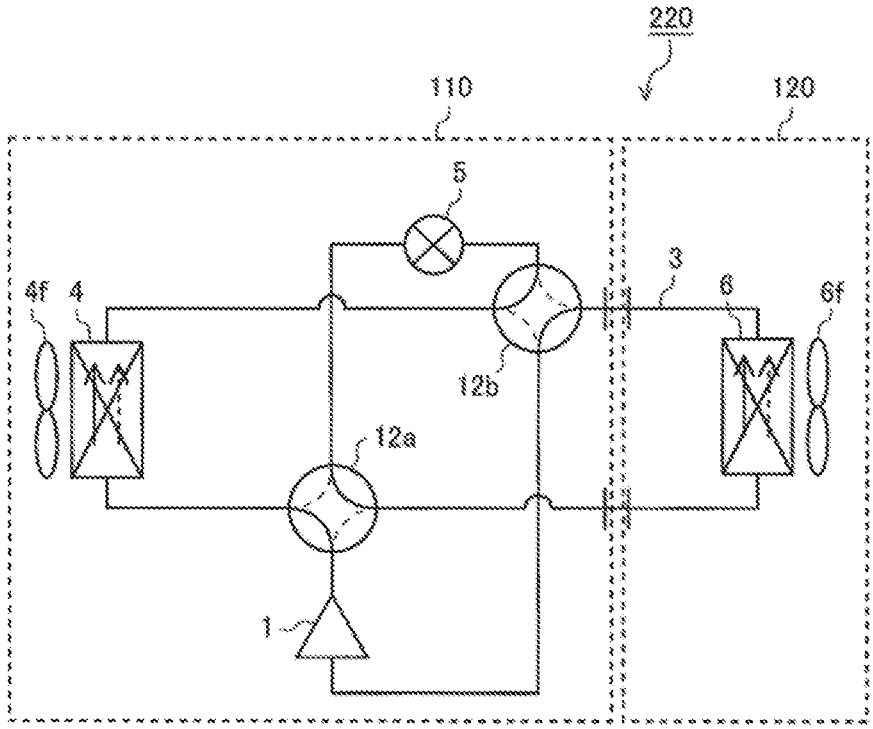
FIG. 7 is a configuration diagram illustrating a modification 3 of the refrigeration cycle apparatus 100 according to Embodiment 1.

FIG. 7 is a configuration diagram illustrating a modification 3 of the refrigeration cycle apparatus 100 according to Embodiment 1.

A refrigeration cycle apparatus 220 according to the modification 3 is different from the refrigeration cycle apparatus 100 according to Embodiment 1 at the point that the direction of the refrigerant flowing through each of the outdoor heat exchanger 4 and the indoor heat exchanger 6 is made the same in the case of the cooling operation and in the case of the heating operation to attain the counter flows.

<Configuration of Refrigeration Cycle Apparatus 220>

A refrigerant circuit (corresponding to the flow switching circuit of the present invention) of the refrigeration cycle apparatus 220 includes the compressor 1, a first four-way valve 12*a*, a second four-way valve 12*b*, the outdoor heat exchanger 4, the expansion valve 5, and the indoor heat exchanger 6. The compressor 1, the first four-way valve 12*a*, the second four-way valve 12*b*, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 220>

Next, an operation of the refrigeration cycle apparatus 220 will be described. The refrigeration cycle apparatus 220 can achieve the cooling operation and the heating operation by switching the flow paths of the first four-way valve 12*a* and the second four-way valve 12*b*.

In the refrigerant circuit during the cooling operation, the refrigeration cycle is formed in the state in which the flow paths of the first four-way valve 12*a* and the second four-way valve 12*b* are switched to solid lines illustrated in FIG. 7. In the case of the cooling operation, the refrigerant sent out from the compressor 1 flows in the order of the first four-way valve 12*a*, the outdoor heat exchanger 4, the second four-way valve 12*b*, the expansion valve 5, the first four-way valve 12*a*, the indoor heat exchanger 6, the second four-way valve 12*b*, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the first four-way valve 12*a* and the second four-way valve 12*b* are switched to broken lines illustrated in FIG. 7. In the case of the heating operation, the refrigerant sent out from the compressor 1 flows in the order of the first four-way valve 12*a*, the indoor heat exchanger 6, the second four-way valve 12*b*, the expansion valve 5, the first four-way valve 12*a*, the outdoor heat exchanger 4, the second four-way valve 12*b*, and the compressor 1. At the time, the indoor heat exchanger 6 acts as a condenser, and the outdoor heat exchanger 4 acts as an evaporator.

By attaining such a refrigerant circuit, the inflow direction of the refrigerant to each of the outdoor heat exchanger 4 and the indoor heat exchanger 6 becomes the same in the case of the cooling operation and in the case of the heating operation.

<Effects>

In the refrigeration cycle apparatus 220 according to the modification 3 of Embodiment 1, the inflow direction of the refrigerant to each of the outdoor heat exchanger 4 and the indoor heat exchanger 6 becomes the same in the case of the cooling operation and in the case of the heating operation to attain the counter flows against the inflow directions of the air, so that, in both of the outdoor heat exchanger 4 and the indoor heat exchanger 6, the similar effects as the outdoor heat exchanger 4 according to Embodiment 1 described above can be obtained.

[Modification 4 of Refrigeration Cycle Apparatus 100]

Figure 8:
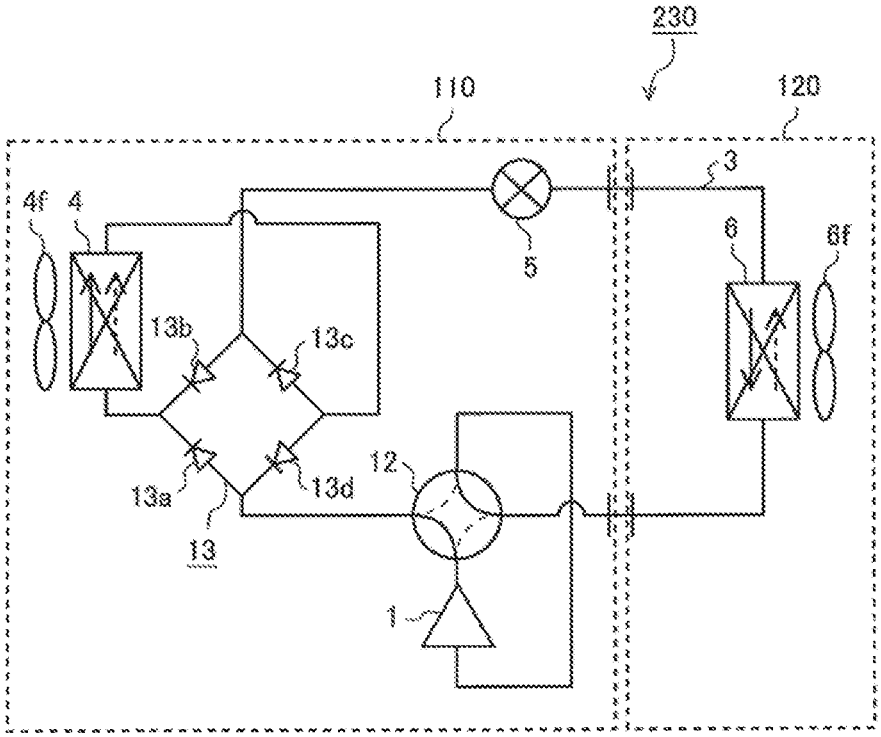
FIG. 8 is a configuration diagram illustrating a modification 4 of the refrigeration cycle apparatus 100 according to Embodiment 1.

FIG. 8 is a configuration diagram illustrating a modification 4 of the refrigeration cycle apparatus 100 according to Embodiment 1.

A refrigeration cycle apparatus 230 according to the modification 4 is a circuit in which the direction of the refrigerant flowing through the outdoor heat exchanger 4 is made the same in the case of the cooling operation and in the case of the heating operation to attain the counter flow, similarly to Embodiment 1.

<Configuration of Refrigeration Cycle Apparatus 230>

A refrigerant circuit (corresponding to the flow switching circuit of the present invention) of the refrigeration cycle apparatus 230 includes the compressor 1, a four-way valve 12, a first check valve bridge circuit 13 constituted of four check valves, the outdoor heat exchanger 4, the expansion valve 5, and the indoor heat exchanger 6. The first check valve bridge circuit 13 is constituted of a first check valve 13*a*, a second check valve 13*b*, a third check valve 13*c*, and a fourth check valve 13*d* that are arranged on a rectangular circuit as illustrated in FIG. 8. The compressor 1, the four-way valve 12, the first check valve bridge circuit 13, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 230>

Next, an operation of the refrigeration cycle apparatus 230 will be described. The refrigeration cycle apparatus 230 can achieve the cooling operation and the heating operation by switching the flow paths of the four-way valve 12.

In the refrigerant circuit during the cooling operation, the refrigeration cycle is formed in the state in which the flow paths of the four-way valve 12 are switched to solid lines illustrated in FIG. 8. In the case of the cooling operation, the refrigerant sent out from the compressor 1 flows in the order of the four-way valve 12, the first check valve 13*a*, the outdoor heat exchanger 4, the third check valve 13*c*, the expansion valve 5, the indoor heat exchanger 6, the four-way valve 12, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the four-way valve 12 are switched to broken lines illustrated in FIG. 8. In the case of the heating operation, the refrigerant sent out from the compressor 1 flows in the order of the four-way valve 12, the indoor heat exchanger 6, the expansion valve 5, the second check valve 13*b*, the outdoor heat exchanger 4, the fourth check valve 13*d*, the four-way valve 12, and the compressor 1. At the time, the indoor heat exchanger 6 acts as a condenser, and the outdoor heat exchanger 4 acts as an evaporator.

By attaining such a refrigerant circuit, the inflow direction of the refrigerant to the outdoor heat exchanger 4 becomes the same in the case of the cooling operation and in the case of the heating operation.

<Effects>

In the refrigeration cycle apparatus 230 according to the modification 4 of Embodiment 1, the inflow direction of the refrigerant to the outdoor heat exchanger 4 becomes the same in the case of the cooling operation and in the case of the heating operation to attain the counter flow against the inflow direction of the air, so that the similar effects as the outdoor heat exchanger 4 according to Embodiment 1 described above can be obtained.

[Modification 5 of Refrigeration Cycle Apparatus 100]

Figure 9:
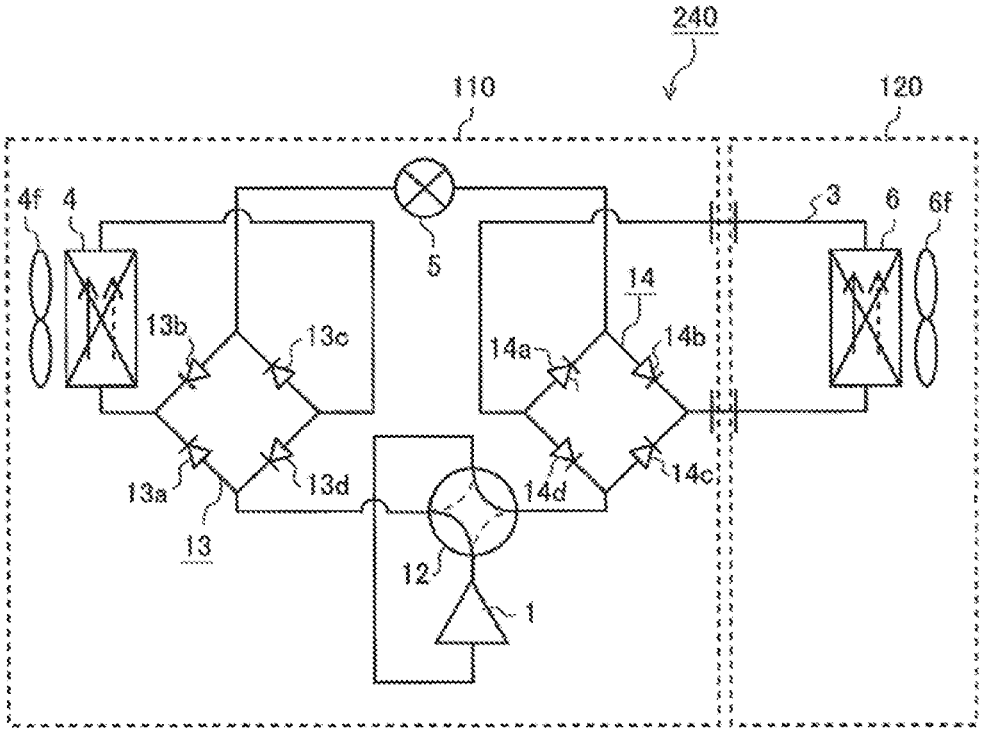
FIG. 9 is a configuration diagram illustrating a modification 5 of the refrigeration cycle apparatus 100 according to Embodiment 1.

FIG. 9 is a configuration diagram illustrating a modification 5 of the refrigeration cycle apparatus 100 according to Embodiment 1.

A refrigeration cycle apparatus 240 according to the modification 5 is different from the refrigeration cycle apparatus 100 according to Embodiment 1 at the point that the direction of the refrigerant flowing through each of the outdoor heat exchanger 4 and the indoor heat exchanger 6 is made the same in the case of the cooling operation and in the case of the heating operation to attain the counter flows.

<Configuration of Refrigeration Cycle Apparatus 240>

A refrigerant circuit (corresponding to the flow switching circuit of the present invention) of the refrigeration cycle apparatus 240 includes the compressor 1, the four-way valve 12, the first check valve bridge circuit 13 constituted of four check valves, a second check valve bridge circuit 14 constituted of four check valves, the outdoor heat exchanger 4, the expansion valve 5, and the indoor heat exchanger 6. The first check valve bridge circuit 13 is constituted of the first check valve 13*a*, the second check valve 13*b*, the third check valve 13*c*, and the fourth check valve 13*d* that are arranged on a rectangular circuit as illustrated in FIG. 9. The second check valve bridge circuit 14 is constituted of a first check valve 14*a*, a second check valve 14*b*, a third check valve 14*c*, and a fourth check valve 14*d* that are arranged on a rectangular circuit as illustrated in FIG. 9. The compressor 1, the four-way valve 12, the first check valve bridge circuit 13, the second check valve bridge circuit 14, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 240>

Next, an operation of the refrigeration cycle apparatus 240 will be described. The refrigeration cycle apparatus 240 can achieve the cooling operation and the heating operation by switching the flow paths of the four-way valve 12.

In the refrigerant circuit during the cooling operation, the refrigeration cycle is formed in the state in which the flow paths of the four-way valve 12 are switched to solid lines illustrated in FIG. 9. In the case of the cooling operation, the refrigerant sent out from the compressor 1 flows in the order of the four-way valve 12, the first check valve 13*a*, the outdoor heat exchanger 4, the third check valve 13*c*, the expansion valve 5, the second check valve 14*b*, the indoor heat exchanger 6, the fourth check valve 14*d*, the four-way valve 12, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the four-way valve 12 are switched to broken lines illustrated in FIG. 9. In the case of the heating operation, the refrigerant sent out from the compressor 1 flows in the order of the four-way valve 12, the third check valve 14*c*, the indoor heat exchanger 6, the first check valve 14*a*, the expansion valve 5, the second check valve 13*b*, the outdoor heat exchanger 4, the fourth check valve 13*d*, the four-way valve 12, and the compressor 1. At the time, the indoor heat exchanger 6 acts as a condenser, and the outdoor heat exchanger 4 acts as an evaporator.

By attaining such a refrigerant circuit, the inflow direction of the refrigerant to each of the outdoor heat exchanger 4 and the indoor heat exchanger 6 becomes the same in the case of the cooling operation and in the case of the heating operation.

<Effects>

In the refrigeration cycle apparatus 240 according to the modification 5 of Embodiment 1, the inflow direction of the refrigerant to each of the outdoor heat exchanger 4 and the indoor heat exchanger 6 becomes the same in the case of the cooling operation and in the case of the heating operation to attain the counter flows against the inflow directions of the air, so that, in both of the outdoor heat exchanger 4 and the indoor heat exchanger 6, the similar effects as the outdoor heat exchanger 4 according to Embodiment 1 described above can be obtained.

[Modification 6 of Refrigeration Cycle Apparatus 100]

Figure 10:
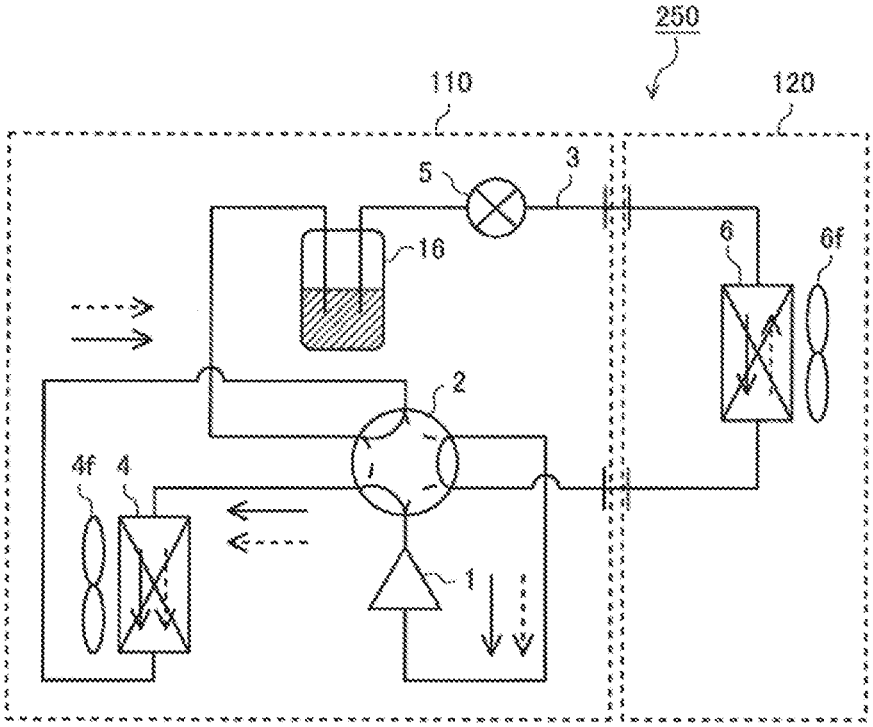
FIG. 10 is a configuration diagram illustrating a modification 6 of the refrigeration cycle apparatus 100 according to Embodiment 1.

FIG. 10 is a configuration diagram illustrating a modification 6 of the refrigeration cycle apparatus 100 according to Embodiment 1.

A refrigeration cycle apparatus 250 according to the modification 6 is different only at the point that a receiver tank 16 is provided in the refrigeration cycle apparatus 100 described in FIG. 1 according to Embodiment 1.

<Configuration of Refrigeration Cycle Apparatus 250>

In a refrigerant circuit (corresponding to the flow switching circuit of the present invention) of the refrigeration cycle apparatus 250, the receiver tank 16 is positioned between the expansion valve and the six-way valve 2 of the refrigeration cycle apparatus 100 described in FIG. 1. The other configuration is the same as the refrigeration cycle apparatus 100 according to Embodiment 1 described in FIG. 1.

<Effects>

In the refrigeration cycle apparatus 250 according to the modification 6 of Embodiment 1, in the case of the cooling operation, subcooled liquid refrigerant stored in the receiver tank 16 is supplied to the indoor heat exchanger 6 acting as an evaporator. Consequently, in addition to the effects of the refrigeration cycle apparatus 100 according to Embodiment 1, a cooling capacity is improved, and efficiency of the refrigeration cycle apparatus 250 is improved.

[Modification 7 of Refrigeration Cycle Apparatus 100]

Figure 11:
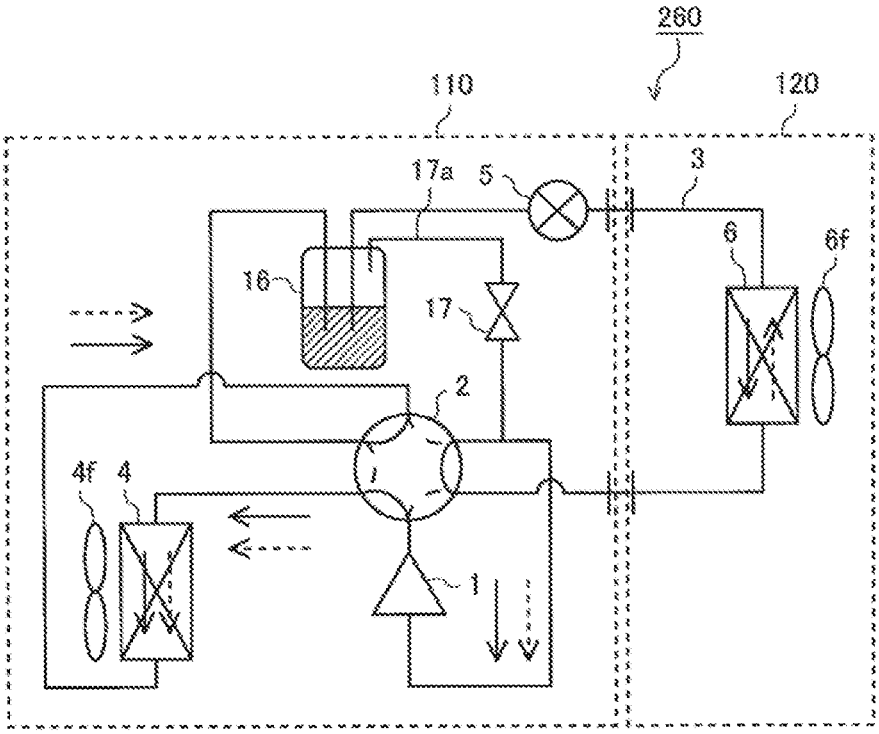
FIG. 11 is a configuration diagram illustrating a modification 7 of the refrigeration cycle apparatus 100 according to Embodiment 1.

FIG. 11 is a configuration diagram illustrating a modification 7 of the refrigeration cycle apparatus 100 according to Embodiment 1.

A refrigeration cycle apparatus 260 according to the modification 7 is different only at the point that a degassing valve 17 is provided to the receiver tank 16 described in FIG. 10 according to the modification 6 of Embodiment 1.

<Configuration of Refrigeration Cycle Apparatus 260>

In a refrigerant circuit (corresponding to the flow switching circuit of the present invention) of the refrigeration cycle apparatus 260, a degassing pipe 17*a* including the degassing valve 17 is provided to the receiver tank 16 of the refrigeration cycle apparatus 250 described in FIG. 10. The other configuration is the same as the refrigeration cycle apparatus 250 according to the modification 6 of Embodiment 1 described in FIG. 10.

<Effects>

The refrigeration cycle apparatus 260 according to the modification 7 of Embodiment 1 includes the degassing valve 17 to be opened in the case of the heating operation and closed in the case of the cooling operation. Consequently, the liquid refrigerant stored in the receiver tank 16 becomes a subcooled state and is supplied to the outdoor heat exchanger 4 acting as an evaporator in the case of the heating operation in particular. Thus, in addition to the effects of the refrigeration cycle apparatus 250 according to the modification 6 of Embodiment 1, a heating capacity is improved, and the efficiency of the refrigeration cycle apparatus 250 is improved.

[Modification 8 of Refrigeration Cycle Apparatus 100]

Figure 12:
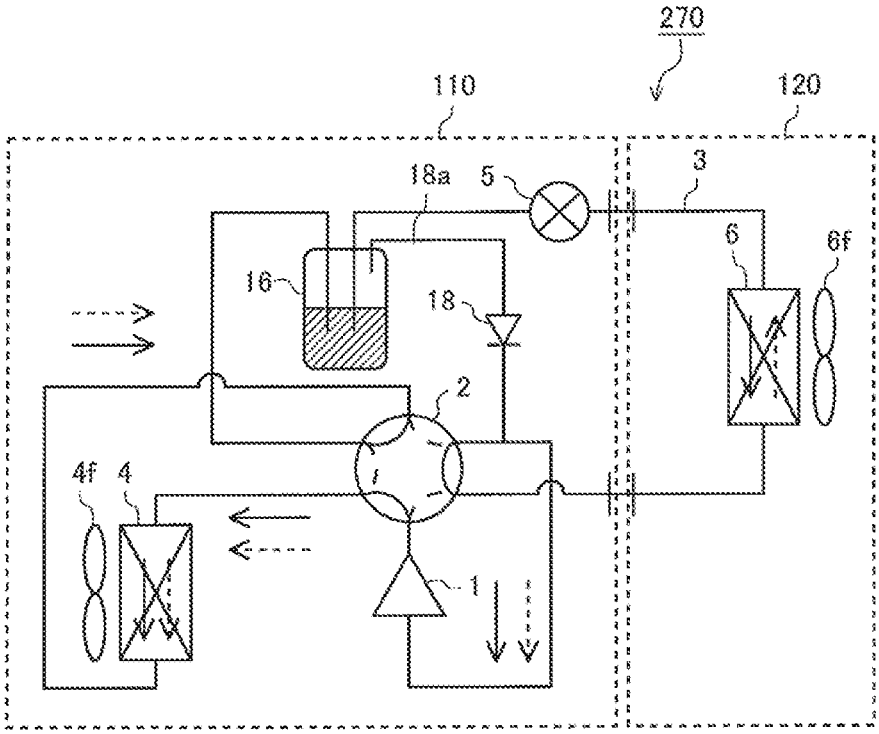
FIG. 12 is a configuration diagram illustrating a modification 8 of the refrigeration cycle apparatus 100 according to Embodiment 1.

FIG. 12 is a configuration diagram illustrating a modification 8 of the refrigeration cycle apparatus 100 according to Embodiment 1.

A refrigeration cycle apparatus 270 according to the modification 8 is different only at the point that a check valve 18 is provided to the receiver tank 16 described in FIG. 10 according to the modification 6 of Embodiment 1.

<Configuration of Refrigeration Cycle Apparatus 270>

In a refrigerant circuit (corresponding to the flow switching circuit of the present invention) of the refrigeration cycle apparatus 270, a degassing pipe 18*a* including the check valve 18 is provided to the receiver tank 16 of the refrigeration cycle apparatus 250 described in FIG. 10. The other configuration is the same as the refrigeration cycle apparatus 250 according to the modification 6 of Embodiment 1 described in FIG. 10.

<Effects>

The refrigeration cycle apparatus 270 according to the modification 8 of Embodiment 1 includes the degassing pipe 18*a* through which gas refrigerant passes in the case of the cooling operation and in the case of the heating operation. Consequently, the liquid refrigerant stored in the receiver tank 16 becomes the subcooled state and is supplied to the outdoor heat exchanger 4 or the indoor heat exchanger 6 acting as an evaporator. Thus, in addition to the effects of the refrigeration cycle apparatus 250 according to the modification 6 of Embodiment 1, the cooling and heating capacities are improved, and the efficiency of the refrigeration cycle apparatus 270 is improved.

[Modification 9 of Refrigeration Cycle Apparatus 100]

Figure 13:
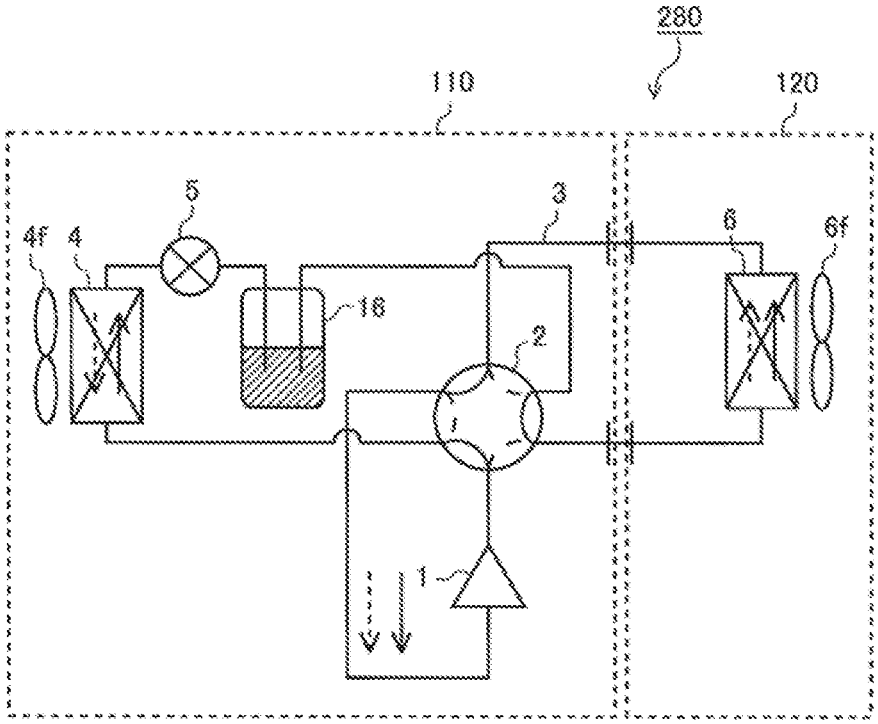
FIG. 13 is a configuration diagram illustrating a modification 9 of the refrigeration cycle apparatus 100 according to Embodiment 1.

FIG. 13 is a configuration diagram illustrating a modification 9 of the refrigeration cycle apparatus 100 according to Embodiment 1.

A refrigeration cycle apparatus 280 according to the modification 9 is different only at the point that the receiver tank 16 is positioned in the refrigeration cycle apparatus 200 described in FIG. 5 according to the modification 1 of Embodiment 1.

<Configuration of Refrigeration Cycle Apparatus 280>

In a refrigerant circuit (corresponding to the flow switching circuit of the present invention) of the refrigeration cycle apparatus 280, the receiver tank 16 is positioned between the expansion valve 5 and the six-way valve 2 of the refrigeration cycle apparatus 100 described in FIG. 5. The other configuration is the same as the refrigeration cycle apparatus 200 according to the modification 1 of Embodiment 1 described in FIG. 5.

<Effects>

In the refrigeration cycle apparatus 280 according to the modification 9 of Embodiment 1, in the case of the cooling operation, the subcooled liquid refrigerant stored in the receiver tank 16 is supplied to the indoor heat exchanger 6 acting as an evaporator. Consequently, in addition to the effects of the refrigeration cycle apparatus 200 according to the modification 1 of Embodiment 1, the cooling capacity is improved, and the efficiency of the refrigeration cycle apparatus 280 is improved.

[Modification 10 of Refrigeration Cycle Apparatus 100]

Figure 14:
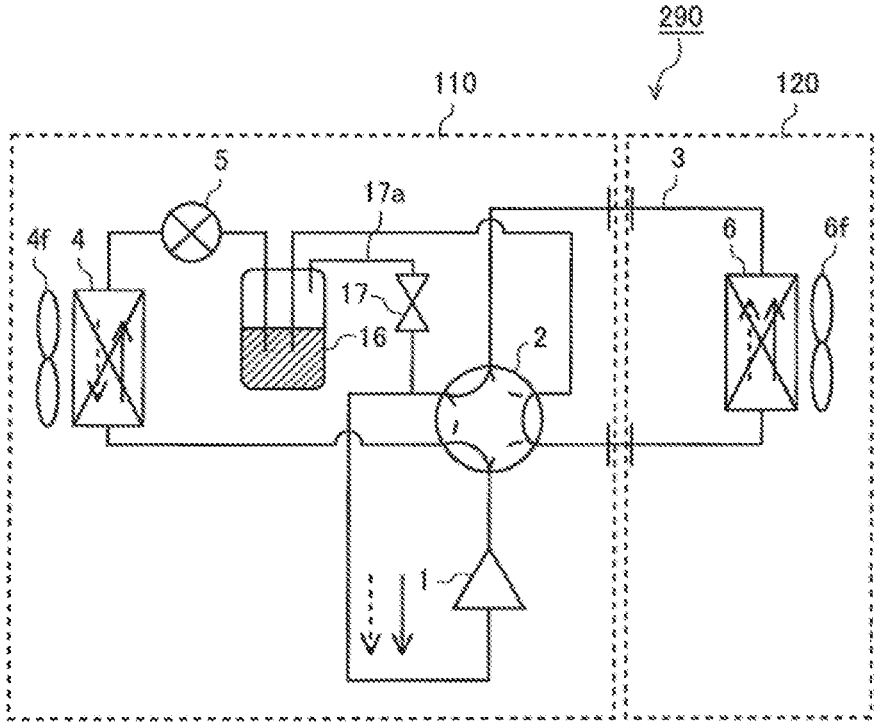
FIG. 14 is a configuration diagram illustrating a modification 10 of the refrigeration cycle apparatus 100 according to Embodiment 1.

FIG. 14 is a configuration diagram illustrating a modification 10 of the refrigeration cycle apparatus 100 according to Embodiment 1.

A refrigeration cycle apparatus 290 according to the modification 10 is different only at the point that the degassing valve 17 is provided to the receiver tank 16 described in FIG. 13 according to the modification 9 of Embodiment 1.

<Configuration of Refrigeration Cycle Apparatus 290>

In a refrigerant circuit (corresponding to the flow switching circuit of the present invention) of the refrigeration cycle apparatus 290, the degassing pipe 17*a* including the degassing valve 17 is provided to the receiver tank 16 of the refrigeration cycle apparatus 280 described in FIG. 13. The other configuration is the same as the refrigeration cycle apparatus 280 according to the modification 9 of Embodiment 1 described in FIG. 13.

<Effects>

The refrigeration cycle apparatus 290 according to the modification 10 of Embodiment 1 includes the degassing valve 17 to be opened in the case of the heating operation and closed in the case of the cooling operation. Consequently, the liquid refrigerant stored in the receiver tank 16 becomes a subcooled state and is supplied to the outdoor heat exchanger 4 acting as an evaporator in the case of the heating operation in particular. Thus, in addition to the effects of the refrigeration cycle apparatus 280 according to the modification 9 of Embodiment 1, the heating capacity is improved, and the efficiency of the refrigeration cycle apparatus 290 is improved.

[Modification 11 of Refrigeration Cycle Apparatus 100]

Figure 15:
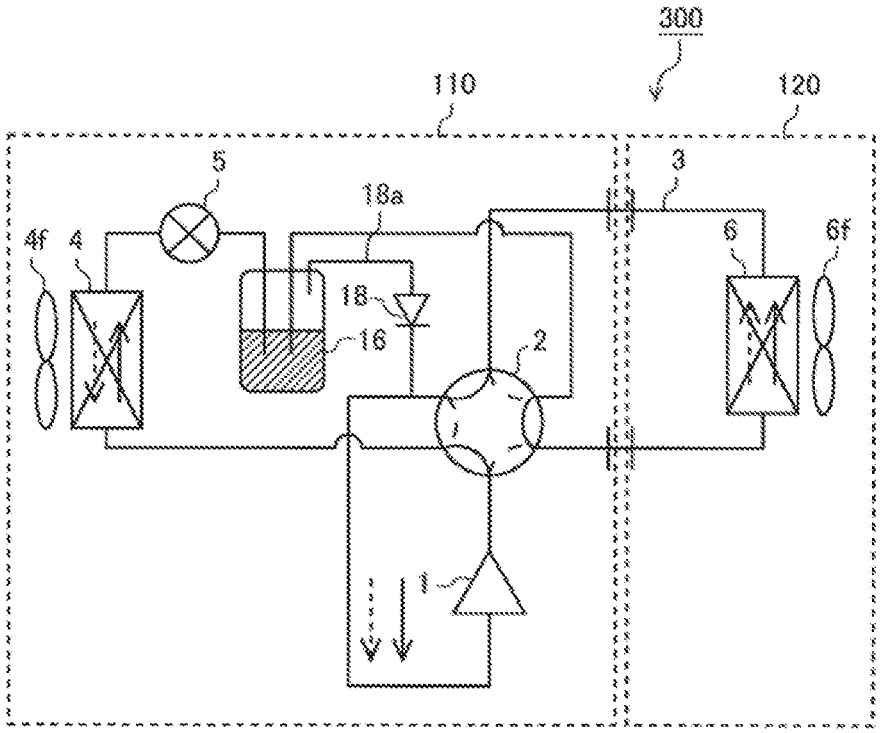
FIG. 15 is a configuration diagram illustrating a modification 11 of the refrigeration cycle apparatus 100 according to Embodiment 1.

FIG. 15 is a configuration diagram illustrating a modification 11 of the refrigeration cycle apparatus 100 according to Embodiment 1.

A refrigeration cycle apparatus 300 according to the modification 11 is different only at the point that the check valve 18 is provided to the receiver tank 16 described in FIG. 13 according to the modification 9 of Embodiment 1.

<Configuration of Refrigeration Cycle Apparatus 300>

In a refrigerant circuit (corresponding to the flow switching circuit of the present invention) of the refrigeration cycle apparatus 300, the degassing pipe 18*a* including the check valve 18 is provided to the receiver tank 16 of the refrigeration cycle apparatus 280 described in FIG. 13. The other configuration is the same as the refrigeration cycle apparatus 280 according to the modification 9 of Embodiment 1 described in FIG. 13.

<Effects>

The refrigeration cycle apparatus 300 according to the modification 11 of Embodiment 1 includes the degassing pipe 18*a* through which the gas refrigerant passes in the case of the cooling operation and in the case of the heating operation. Consequently, the liquid refrigerant stored in the receiver tank 16 becomes the subcooled state and is supplied to the outdoor heat exchanger 4 or the indoor heat exchanger 6 acting as an evaporator. Thus, in addition to the effects of the refrigeration cycle apparatus 280 according to the modification 9 of Embodiment 1, the cooling and heating capacities are improved, and the efficiency of the refrigeration cycle apparatus 300 is improved.

Next, modifications of the path switching circuit 10 according to Embodiment 1 will be described.

[Modification 1 of Path Switching Circuit 10]

Figure 16:
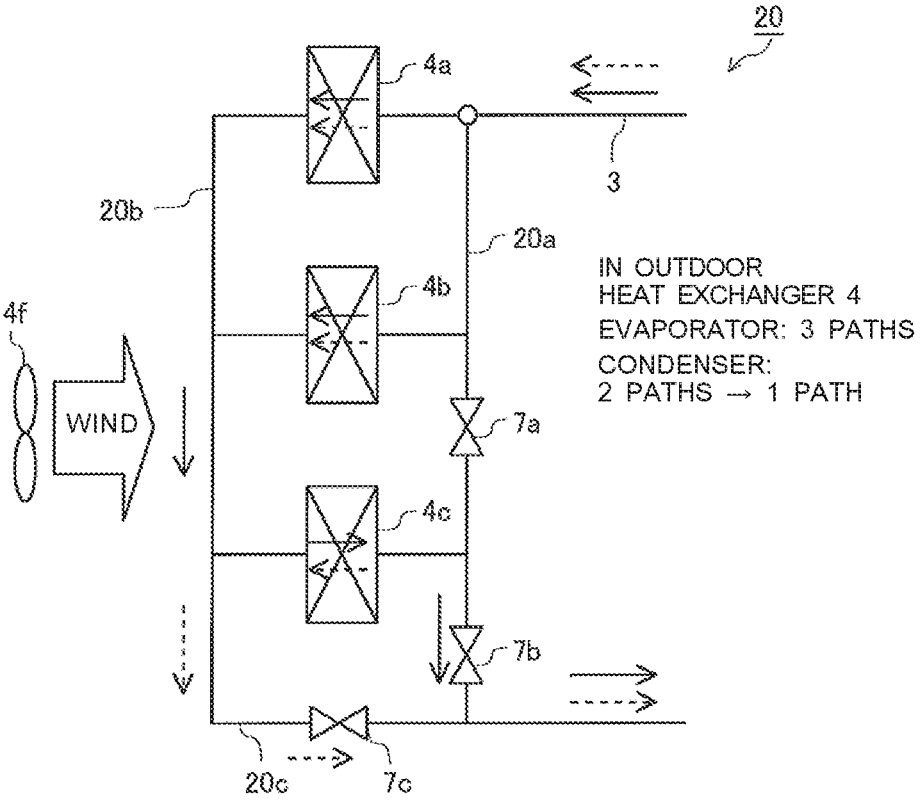
FIG. 16 is a configuration diagram illustrating a modification 1 of the path switching circuit 10 according to Embodiment 1.

FIG. 16 is a configuration diagram illustrating a modification 1 of the path switching circuit 10 according to Embodiment 1.

A path switching circuit 20 according to the modification 1 is the same as the path switching circuit 10 according to Embodiment 1 in a basic connection configuration, as illustrated in FIG. 16. However, as arrangement and other features of each switching valve are different, the configuration of each switching valve will be described.

The path switching circuit 20 according to the modification 1 is constituted of a first flow path 20*a* connecting each refrigerant pipe on the leeward side of the first heat exchange unit 4*a*, the second heat exchange unit 4*b*, and the third heat exchange unit 4*c*, a second flow path 20*b* connecting each refrigerant pipe on the windward side of the first heat exchange unit 4*a*, the second heat exchange unit 4*b*, and the third heat exchange unit 4*c*, and a third flow path 20*c* connecting the first flow path 20*a* and the second flow path 20*b* and bypassing the third heat exchange unit 4*c*.

Between the second heat exchange unit 4*b* and the third heat exchange unit 4*c* in the first flow path 20*a*, the first on-off valve 7*a* is positioned. In addition, at the connecting position with the third flow path 20*c* in the first flow path 20*a*, a second on-off valve 7*b* is provided. Further, a third on-off valve 7*c* is provided in the third flow path 20*c*.

<Flow of Refrigerant in Path Switching Circuit 20>

In the case of the cooling operation, the refrigerant flows as the solid lines to the path switching circuit 20 of the outdoor heat exchanger 4. That is, by closing the first on-off valve 7*a*, the high-pressure gas refrigerant flowing into the path switching circuit 20 flows into the first heat exchange unit 4*a* and the second heat exchange unit 4*b* first and is condensed. The refrigerant flowing out of the first heat exchange unit 4*a* and the second heat exchange unit 4*b* flows into the third heat exchange unit 4*c*, by opening the second on-off valve 7*b* and closing the third on-off valve 7*c*, and becomes the liquid refrigerant. Then, the liquid refrigerant is supplied to the indoor heat exchanger 6. At the time, the refrigerant of the low quality flows from the first heat exchange unit 4*a* and the second heat exchange unit 4*b* to the third heat exchange unit 4*c* at the lower position.

In the case of the heating operation, the refrigerant flows as the broken lines to the path switching circuit 20 of the outdoor heat exchanger 4. That is, by opening the first on-off valve 7*a* and closing the second on-off valve 7*b*, the low-pressure liquid refrigerant flowing into the path switching circuit 20 flows into the first heat exchange unit 4*a*, the second heat exchange unit 4*b*, and the third heat exchange unit 4*c* in parallel and evaporates. The gas refrigerant flowing out of each heat exchange unit is sucked by the compressor 1, by opening the third on-off valve 7*c*.

<Effects>

In the path switching circuit 20 of the modification 1 according to Embodiment 1, the same effects as the path switching circuit 10 according to Embodiment 1 described above can be obtained.

[Modification 2 of Path Switching Circuit 10]

Figure 17:
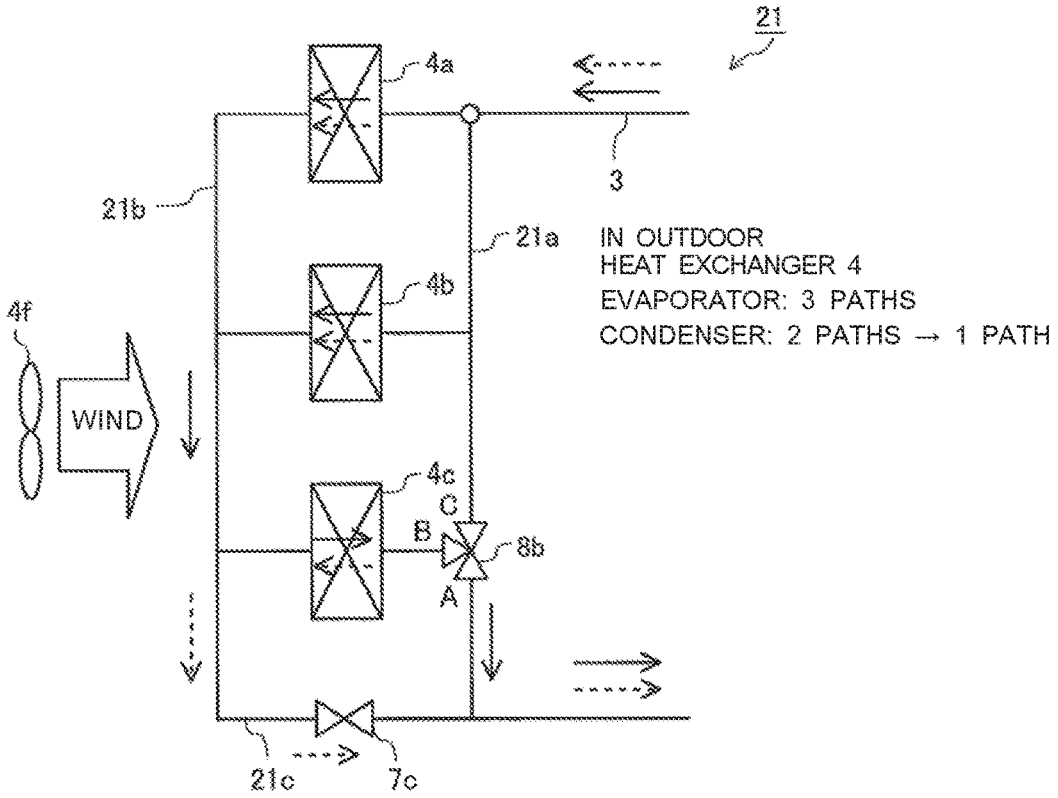
FIG. 17 is a configuration diagram illustrating a modification 2 of the path switching circuit 10 according to Embodiment 1.

FIG. 17 is a configuration diagram illustrating a modification 2 of the path switching circuit 10 according to Embodiment 1.

A path switching circuit 21 according to the modification 2 is the same as the path switching circuit 10 according to Embodiment 1 in the basic connection configuration, as illustrated in FIG. 17. However, as the arrangement and other features of each switching valve are different, the configuration of each switching valve will be described.

The path switching circuit 21 according to the modification 2 is constituted of a first flow path 21*a* connecting each refrigerant pipe on the leeward side of each path of the first heat exchange unit 4*a*, the second heat exchange unit 4*b*, and the third heat exchange unit 4*c*, a second flow path 21*b* connecting each refrigerant pipe on the windward side of each path of the first heat exchange unit 4*a*, the second heat exchange unit 4*b*, and the third heat exchange unit 4*c*, and a third flow path 21*c* connecting the first flow path 21*a* and the second flow path 21*b* and bypassing the third heat exchange unit 4*c*.

At a connection section with the third heat exchange unit 4*c* in the first flow path 21*a*, a second three-way valve 8*b* including three ports (ports A to C) is provided. In addition, in the third flow path 21*c*, the third on-off valve 7*c* is positioned.

<Flow of Refrigerant in Path Switching Circuit 21>

In the case of the cooling operation, the refrigerant flows as the solid lines to the path switching circuit 21 of the outdoor heat exchanger 4. That is, by closing the port C of the second three-way valve 8*b* and opening the port A and the port B, the high-pressure gas refrigerant flowing into the path switching circuit 21 flows into the first heat exchange unit 4*a* and the second heat exchange unit 4*b* first and is condensed. The refrigerant flowing out of the first heat exchange unit 4*a* and the second heat exchange unit 4*b* flows into the third heat exchange unit 4*c*, by closing the third on-off valve 7*c*, and becomes the liquid refrigerant. Then, the liquid refrigerant is supplied to the indoor heat exchanger 6. At the time, the refrigerant of the low quality flows from the first heat exchange unit 4*a* and the second heat exchange unit 4*b* to the third heat exchange unit 4*c* at the lower position.

In the case of the heating operation, the refrigerant flows as the broken lines to the path switching circuit 21 of the outdoor heat exchanger 4. That is, by opening the port B and the port C of the second three-way valve 8*b* and closing the port A, the low-pressure liquid refrigerant flowing into the path switching circuit 21 flows into the first heat exchange unit 4*a*, the second heat exchange unit 4*b*, and the third heat exchange unit 4*c* in parallel and evaporates. The gas refrigerant flowing out of each heat exchange unit is sucked by the compressor 1, by opening the third on-off valve 7*c*.

<Effects>

In the path switching circuit 21 of the modification 2 according to Embodiment 1, the same effects as the path switching circuit 10 according to Embodiment 1 described above can be obtained.

[Modification 3 of Path Switching Circuit 10]

Figure 18:
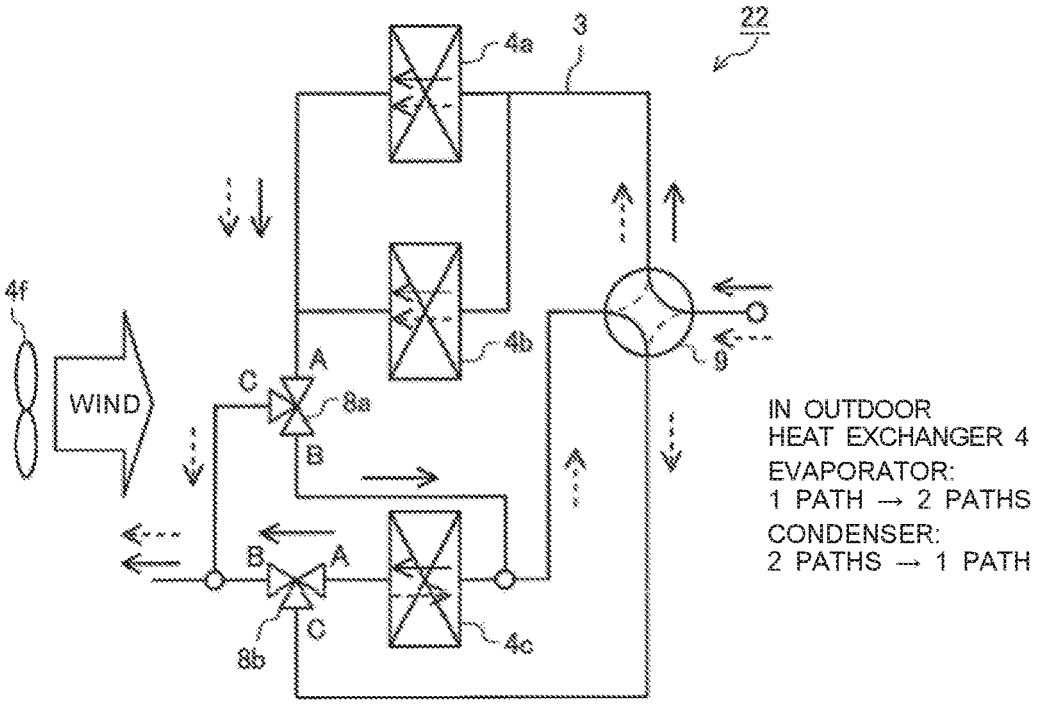
FIG. 18 is a configuration diagram illustrating a modification 3 of the path switching circuit 10 according to Embodiment 1.

FIG. 18 is a configuration diagram illustrating a modification 3 of the path switching circuit 10 according to Embodiment 1.

A path switching circuit 22 according to the modification 3 is different from the path switching circuit 10 according to Embodiment 1 in the connection configuration, as illustrated in FIG. 18.

The path switching circuit 22 according to the modification 3 includes a four-way valve 9 configured to switch the individual paths of the first heat exchange unit 4*a*, the second heat exchange unit 4*b*, and the third heat exchange unit 4*c* from the connection of two paths to one path or from one path to two paths, the first three-way valve 8*a*, and the second three-way valve 8*b*.

The first three-way valve 8*a* and the second three-way valve 8*b* each include three ports (ports A to C).

<Flow of Refrigerant in Path Switching Circuit 22>

In the case of the cooling operation, the refrigerant flows as the solid lines to the path switching circuit 22 of the outdoor heat exchanger 4. That is, the four-way valve 9 is switched to a solid line direction, the port C of the first three-way valve 8*a* is closed, and the port A and the port B of the first three-way valve 8*a* are opened. In addition, the port C of the second three-way valve 8*b* is closed, and the port A and the port B of the second three-way valve 8*b* are opened. Consequently, the high-pressure gas refrigerant flowing into the path switching circuit 22 flows into the first heat exchange unit 4*a* and the second heat exchange unit 4*b* first and is condensed. The refrigerant flowing out of the first heat exchange unit 4*a* and the second heat exchange unit 4*b* passes through the first three-way valve 8*a*, flows into the third heat exchange unit 4*c*, and becomes the liquid refrigerant. Then, the liquid refrigerant passes through the second three-way valve 8*b* and is supplied to the indoor heat exchanger 6. At the time, the refrigerant of the low quality flows from the first heat exchange unit 4*a* and the second heat exchange unit 4*b* to the third heat exchange unit 4*c* at the lower position.

In the case of the heating operation, the refrigerant flows as the broken lines to the path switching circuit 22 of the outdoor heat exchanger 4. That is, the four-way valve 9 is switched to a broken line direction, the port B of the first three-way valve 8*a* is closed, and the port A and the port C of the first three-way valve 8*a* are opened. In addition, the port B of the second three-way valve 8*b* is closed, and the port A and the port C of the second three-way valve 8*b* are opened. Consequently, the high-pressure gas refrigerant flowing into the path switching circuit 22 passes through the four-way valve 9 and the second three-way valve 8*b*, flows into the third heat exchange unit 4*c*, and evaporates. The refrigerant flowing out of the third heat exchange unit 4*c* passes through the four-way valve 9, flows into the first heat exchange unit 4*a* and the second heat exchange unit 4*b*, and becomes the gas refrigerant. Then, the gas refrigerant passes through the first three-way valve 8*a*, and is sucked by the compressor 1.

<Effects>

In the path switching circuit 22 of the modification 3 according to Embodiment 1, the individual paths are switched such that the refrigerant flows from two paths to one path when the outdoor heat exchanger 4 acts as a condenser, and are switched such that the refrigerant flows from one path to two paths when the outdoor heat exchanger 4 acts as an evaporator. Consequently, as the paths are changed depending on decrease and increase of the volume of the refrigerant due to the phase change of the refrigerant, the pressure loss can be reduced, and the heat exchange efficiency can be improved.

Embodiment 2

The refrigeration cycle apparatus according to Embodiment 2 will be described.

<Configuration of Refrigeration Cycle Apparatus 400>

Figure 19:
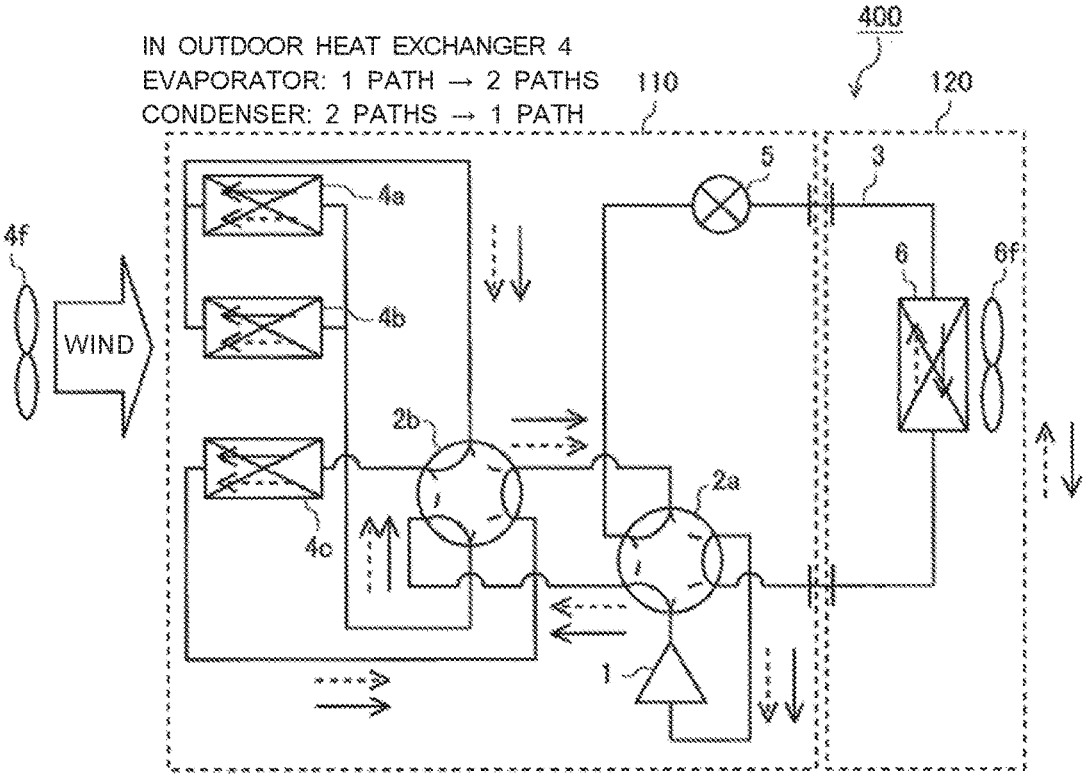
FIG. 19 is a configuration diagram of a refrigeration cycle apparatus 400 according to Embodiment 2.

FIG. 19 is a configuration diagram of a refrigeration cycle apparatus 400 according to Embodiment 2.

The refrigeration cycle apparatus 400 includes the outdoor unit 110 and the indoor unit 120. The outdoor unit 110 and the indoor unit 120 are connected to each other through the refrigerant pipes 3. In the refrigeration cycle apparatus 400, a refrigerant circuit is formed by the outdoor unit 110, the indoor unit 120, and the refrigerant pipes 3.

The refrigerant circuit (corresponding to the flow switching circuit of the present invention) includes the compressor 1, a first six-way valve 2*a*, a second six-way valve 2*b*, the outdoor heat exchanger 4, the expansion valve 5, and the indoor heat exchanger 6. The compressor 1, the first six-way valve 2*a*, the second six-way valve 2*b*, the outdoor heat exchanger 4, and the expansion valve 5 are housed in the outdoor unit 110. On the other hand, the indoor heat exchanger 6 is housed in the indoor unit 120. In the vicinity of the outdoor heat exchanger 4, an outdoor fan (not illustrated) configured to supply the air for the heat exchange to the outdoor heat exchanger 4 is installed. In addition, in the vicinity of the indoor heat exchanger 6, an indoor fan (not illustrated) configured to supply the air for the heat exchange to the indoor heat exchanger 6 is installed. The outdoor heat exchanger 4 includes three paths for example. To the respective three paths, the first heat exchange unit 4*a*, the second heat exchange unit 4*b*, and the third heat exchange unit 4*c* are connected. Note that, in the vertical direction, it is desirable to position the third heat exchange unit 4*c* below the first heat exchange unit 4*a* and the second heat exchange unit 4*b*.

Note that the above-described configuration includes the minimum components capable of achieving the present invention, and a gas-liquid branching unit, a receiver, an accumulator, a high-low pressure heat exchanger, and other components may be connected to form the refrigeration cycle apparatus 400.

For the refrigerant used in the refrigeration cycle apparatus 400, not only single component refrigerant but also an azeotropic, near-azeotropic, or zeotropic refrigerant mixture in which at least two kinds of refrigerant are mixed can be adopted. Note that the refrigerant can be mixed with an optional mixing ratio of the refrigerant such as R32, HFO1234yf, HFO1234ze(E), R125, HFO1123, R134a, and R290.

<Operation of Refrigeration Cycle Apparatus 400>

Next, an operation of the refrigeration cycle apparatus 400 will be described.

The refrigeration cycle apparatus 400 can achieve the cooling operation and the heating operation by switching the flow paths of the first six-way valve 2*a* and the second six-way valve 2*b*.

In the refrigerant circuit during the cooling operation, a refrigeration cycle is formed in the state in which the flow paths of the first six-way valve 2*a* and the second six-way valve 2*b* are switched to solid lines illustrated in FIG. 19. In the case of the cooling operation, the refrigerant sent out from the compressor 1 flows in the order of the first six-way valve 2*a*, the second six-way valve 2*b*, the first heat exchange unit 4*a* and the second heat exchange unit 4*b*, the second six-way valve 2*b*, the third heat exchange unit 4*c*, the second six-way valve 2*b*, the first six-way valve 2*a*, the expansion valve 5, the indoor heat exchanger 6, the first six-way valve 2*a*, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the first six-way valve 2*a* and the second six-way valve 2*b* are switched to broken lines illustrated in FIG. 19. In the case of the heating operation, the refrigerant sent out from the compressor 1 flows in the order of the first six-way valve 2*a*, the indoor heat exchanger 6, the expansion valve 5, the first six-way valve 2*a*, the second six-way valve 2*b*, the third heat exchange unit 4*c*, the second six-way valve 2*b*, the first heat exchange unit 4*a* and the second heat exchange unit 4*b*, the second six-way valve 2*b*, the first six-way valve 2*a*, and the compressor 1. At the time, the indoor heat exchanger 6 acts as a condenser, and the outdoor heat exchanger 4 acts as an evaporator.

By attaining such a refrigerant circuit, the inflow direction of the refrigerant to each path of the outdoor heat exchanger 4 becomes the same in the case of the cooling operation and in the case of the heating operation.

<Effects>

In the refrigeration cycle apparatus 400 according to Embodiment 2, in the outdoor heat exchanger 4, the refrigerant flows in from the same direction in the case of the cooling operation and in the case of the heating operation. Thus, the air for the heat exchange supplied from the outdoor fan and the refrigerant flowing through the heat transfer tube of the outdoor heat exchanger 4 exchange heat as counter flows. Consequently, as a temperature difference between the air and the refrigerant can be kept small at all times in the heat exchange process compared to a parallel flow, the heat exchange efficiency is improved, the high and low pressure difference of the refrigeration cycle apparatus 300 is maintained small, and the input of the compressor 1 can be reduced. Note that the improvement of the heat exchange efficiency by the counter flows becomes remarkable when a zeotropic refrigerant mixture, which has a temperature glide during the heat exchange, is used. In addition, by attaining the counter flows, an evaporating temperature in the case of the heating operation is maintained high, and a frosting amount can be reduced. Furthermore, by positioning the third heat exchange unit 4*c* below the first heat exchange unit 4*a* and the second heat exchange unit 4*b* in the vertical direction, the condensed liquid refrigerant can be guided in the gravity direction, and influence of a liquid head can be reduced.

In addition, in the refrigerant circuit according to Embodiment 2, the number of the paths of the outdoor heat exchanger 4 is switched in the case of the cooling operation and in the case of the heating operation, and when the outdoor heat exchanger 4 acts as a condenser, the number of the inflow paths is two and the number of the outflow paths is changed to one. In addition, when the outdoor heat exchanger 4 acts as an evaporator, the number of the inflow paths is one and the number of the outflow paths is changed to two. Consequently, as the number of the paths is changed depending on the decrease and increase of the volume of the refrigerant due to the phase change of the refrigerant, the pressure loss can be reduced, and the heat exchange efficiency can be improved.

Next, modifications of the refrigeration cycle apparatus 400 according to Embodiment 2 will be described.

[Modification 1 of Refrigeration Cycle Apparatus 400]

Figure 20:
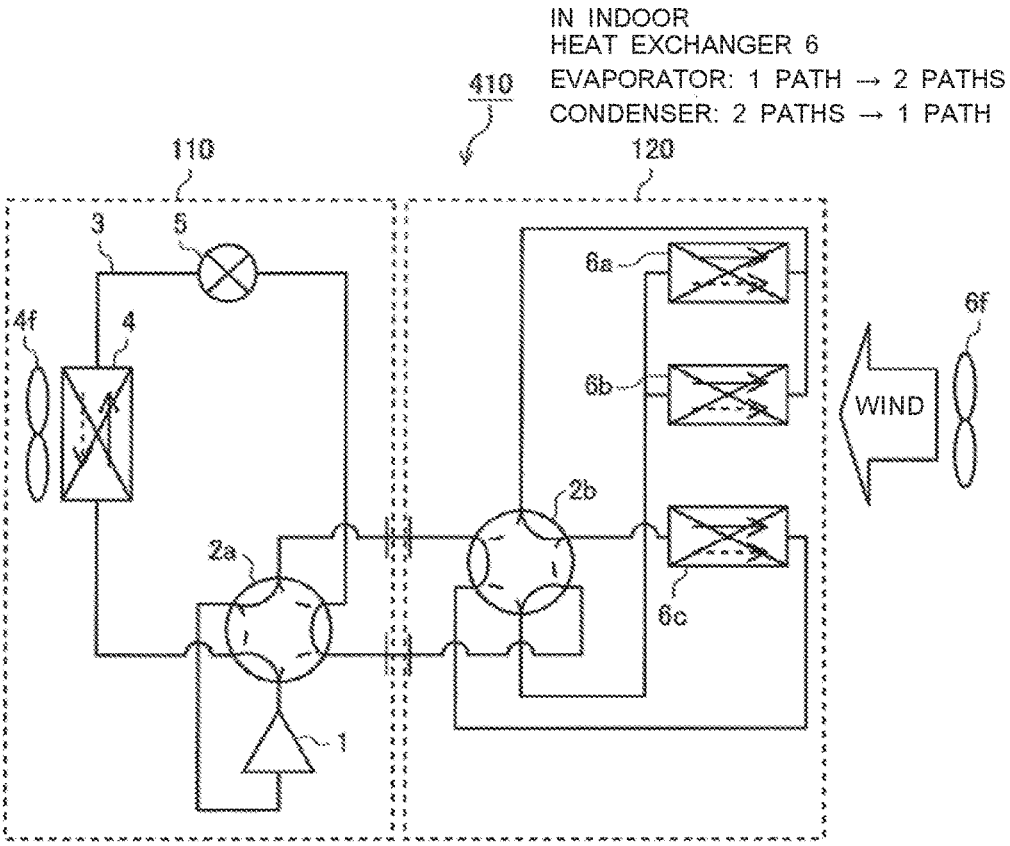
FIG. 20 is a configuration diagram illustrating a modification 1 of the refrigeration cycle apparatus 400 according to Embodiment 2.

FIG. 20 is a configuration diagram illustrating a modification 1 of the refrigeration cycle apparatus 400 according to Embodiment 2.

A refrigeration cycle apparatus 410 according to the modification 1 is different from the refrigeration cycle apparatus 100 according to Embodiment 1 at the point that the direction of the refrigerant flowing through the indoor heat exchanger 6 is made the same in the case of the cooling operation and in the case of the heating operation to attain the counter flows.

<Configuration of Refrigeration Cycle Apparatus 410>

A refrigerant circuit (corresponding to the flow switching circuit of the present invention) of the refrigeration cycle apparatus 410 includes the compressor 1, the first six-way valve 2*a*, the second six-way valve 2*b*, the outdoor heat exchanger 4, the expansion valve 5, and the indoor heat exchanger 6, similarly to the refrigeration cycle apparatus 400. The compressor 1, the first six-way valve 2*a*, the second six-way valve 2*b*, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 410>

Next, an operation of the refrigeration cycle apparatus 410 will be described. The refrigeration cycle apparatus 410 can achieve the cooling operation and the heating operation by switching the flow paths of the first six-way valve 2*a* and the second six-way valve 2*b*.

In the refrigerant circuit during the cooling operation, the refrigeration cycle is formed in the state in which the flow paths of the first six-way valve 2*a* and the second six-way valve 2*b* are switched to solid lines illustrated in FIG. 20. In the case of the cooling operation, the refrigerant sent out from the compressor 1 flows in the order of the first six-way valve 2*a*, the outdoor heat exchanger 4, the expansion valve 5, the first six-way valve 2*a*, the second six-way valve 2*b*, a third heat exchange unit 6*c*, the second six-way valve 2*b*, a first heat exchange unit 6*a* and a second heat exchange unit 6*b*, the second six-way valve 2*b*, the first six-way valve 2*a*, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the first six-way valve 2*a* and the second six-way valve 2*b* are switched to broken lines illustrated in FIG. 20. In the case of the heating operation, the refrigerant sent out from the compressor 1 flows in the order of the first six-way valve 2*a*, the second six-way valve 2*b*, the first heat exchange unit 6*a* and the second heat exchange unit 6*b*, the second six-way valve 2*b*, the third heat exchange unit 6*c*, the second six-way valve 2*b*, the first six-way valve 2*a*, the expansion valve 5, the outdoor heat exchanger 4, the first six-way valve 2*a*, and the compressor 1. At the time, the indoor heat exchanger 6 acts as a condenser, and the outdoor heat exchanger 4 acts as an evaporator.

By attaining such a refrigerant circuit, the inflow direction of the refrigerant to the indoor heat exchanger 6 becomes the same in the case of the cooling operation and in the case of the heating operation.

<Effects>

In the refrigeration cycle apparatus 410 according to the modification 1 of Embodiment 2, the inflow direction of the refrigerant to the indoor heat exchanger 6 becomes the same in the case of the cooling operation and in the case of the heating operation and the number of the paths is changed depending on an operation mode, so that, in the indoor heat exchanger 6, similar effects as the outdoor heat exchanger 4 of the refrigeration cycle apparatus 400 according to Embodiment 2 described above can be obtained.

[Modification 2 of Refrigeration Cycle Apparatus 400]

Figure 21:
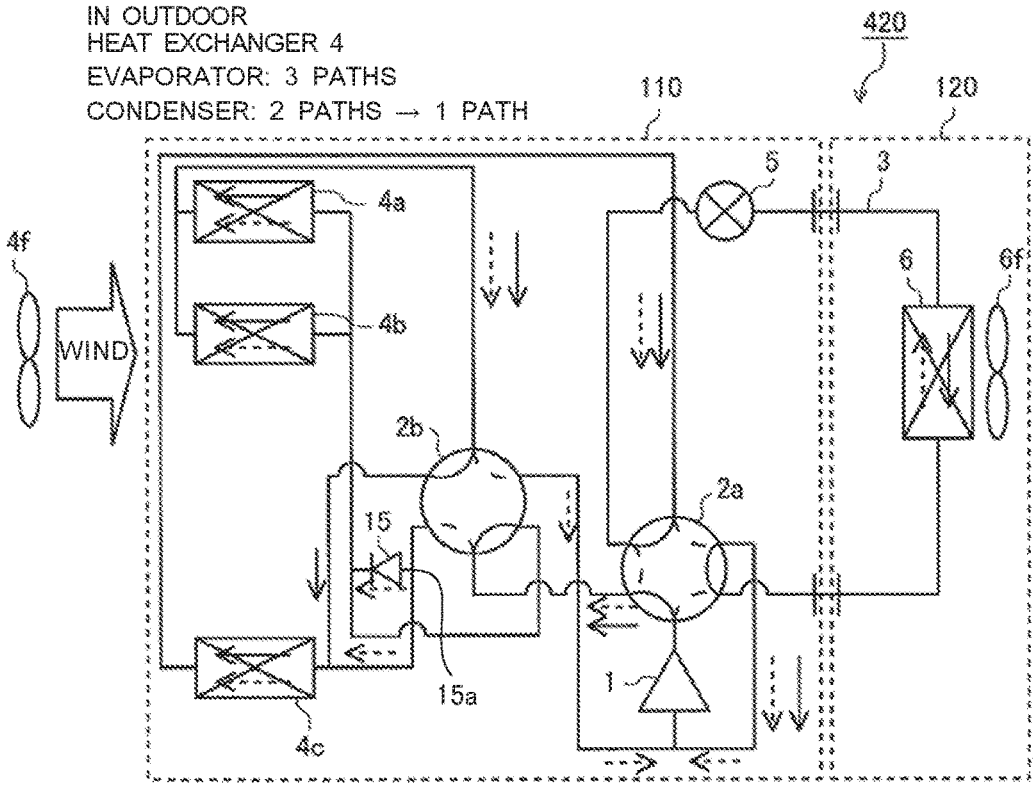
FIG. 21 is a configuration diagram illustrating a modification 2 of the refrigeration cycle apparatus 400 according to Embodiment 2.

FIG. 21 is a configuration diagram illustrating a modification 2 of the refrigeration cycle apparatus 400 according to Embodiment 2.

A refrigeration cycle apparatus 420 according to the modification 2 is different from the refrigeration cycle apparatus 400 according to Embodiment 2 at the point that all the paths of the refrigerant flowing through the outdoor heat exchanger 4 acting as an evaporator during the heating operation are parallelized.

<Configuration of Refrigeration Cycle Apparatus 420>

A refrigerant circuit (corresponding to the flow switching circuit of the present invention) of the refrigeration cycle apparatus 420 includes the compressor 1, the first six-way valve 2*a*, the second six-way valve 2*b*, the outdoor heat exchanger 4, the expansion valve 5, and the indoor heat exchanger 6, similarly to the refrigeration cycle apparatus 400. The compressor 1, the first six-way valve 2*a*, the second six-way valve 2*b*, the outdoor heat exchanger 4, and the expansion valve 5 are housed in the outdoor unit 110. On the other hand, the indoor heat exchanger 6 is housed in the indoor unit 120.

<Operation of Refrigeration Cycle Apparatus 420>

Next, an operation of the refrigeration cycle apparatus 420 will be described. The refrigeration cycle apparatus 420 can achieve the cooling operation and the heating operation by switching the flow paths of the first six-way valve 2*a* and the second six-way valve 2*b*.

In the refrigerant circuit during the cooling operation, the refrigeration cycle is formed in the state in which the flow paths of the first six-way valve 2*a* and the second six-way valve 2*b* are switched to solid lines illustrated in FIG. 21. In the case of the cooling operation, the refrigerant sent out from the compressor 1 flows in the order of the first six-way valve 2*a*, the second six-way valve 2*b*, the first heat exchange unit 4*a* and the second heat exchange unit 4*b*, the second six-way valve 2*b*, the third heat exchange unit 4*c*, the second six-way valve 2*b*, the first six-way valve 2*a*, the expansion valve 5, the indoor heat exchanger 6, the first six-way valve 2*a*, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the first six-way valve 2*a* and the second six-way valve 2*b* are switched to broken lines illustrated in FIG. 21. In the case of the heating operation, the refrigerant sent out from the compressor 1 flows in the order of the first six-way valve 2*a*, the indoor heat exchanger 6, the expansion valve 5, the first six-way valve 2*a*, the second six-way valve 2*b*, and a branching point 15*a* leading to a check valve 15. One stream of the refrigerant branched at the branching point 15*a* passes through the check valve 15, flows into the first heat exchange unit 4*a* and the second heat exchange unit 4*b*, and is sucked by the compressor 1 from the second six-way valve 2*b*. The other stream of the refrigerant branched at the branching point 15*a* passes through the third heat exchange unit 4*c* and the first six-way valve 2*a*, and is sucked by the compressor 1. At the time, the indoor heat exchanger 6 acts as a condenser, and the outdoor heat exchanger 4 acts as an evaporator.

By attaining such a refrigerant circuit, the inflow direction of the refrigerant to each path of the outdoor heat exchanger 4 becomes the same in the case of the cooling operation and in the case of the heating operation.

<Effects>

In the refrigeration cycle apparatus 420 according to the modification 2 of Embodiment 2, the inflow direction of the refrigerant to the outdoor heat exchanger 4 becomes the same in the case of the cooling operation and in the case of the heating operation, so that, in the indoor heat exchanger 6, similar effects as the outdoor heat exchanger 4 of the refrigeration cycle apparatus 400 according to Embodiment 2 described above can be obtained.

[Modification 3 of Refrigeration Cycle Apparatus 400]

Figure 22:
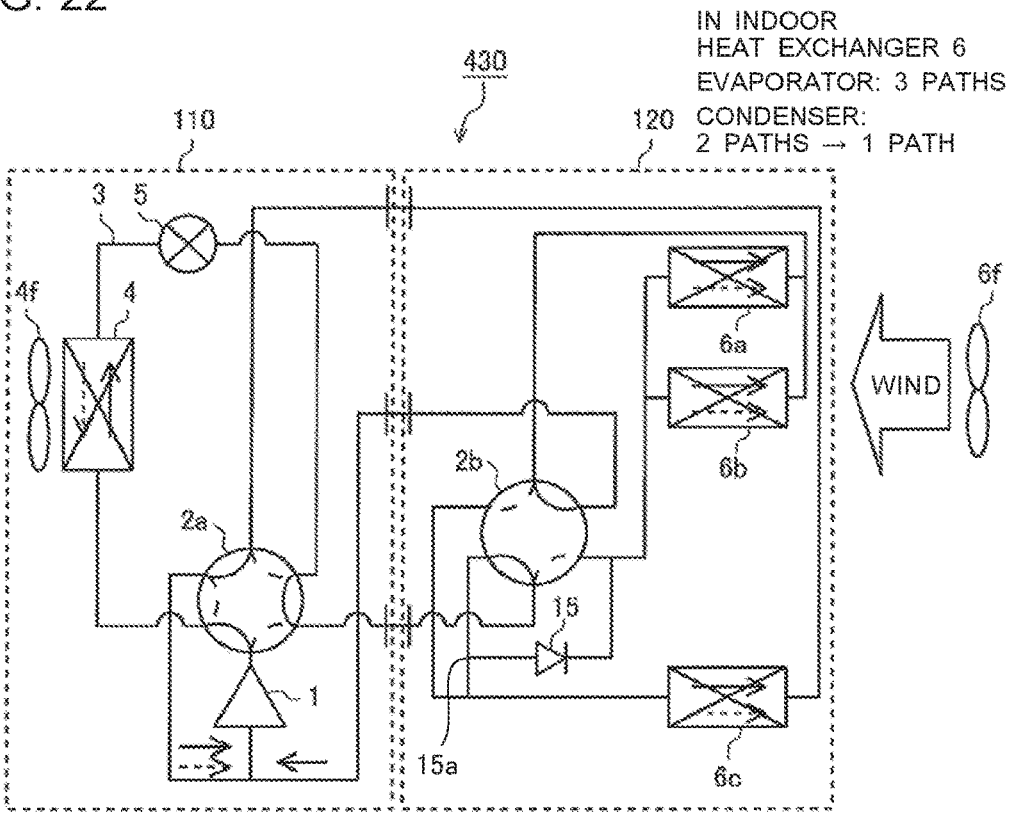
FIG. 22 is a configuration diagram illustrating a modification 3 of the refrigeration cycle apparatus 400 according to Embodiment 2.

FIG. 22 is a configuration diagram illustrating a modification 3 of the refrigeration cycle apparatus 400 according to Embodiment 2.

A refrigeration cycle apparatus 430 according to the modification 3 is different from the refrigeration cycle apparatus 400 according to Embodiment 2 at the point that all the paths of the refrigerant flowing through the indoor heat exchanger 6 acting as an evaporator during the cooling operation are parallelized.

<Configuration of Refrigeration Cycle Apparatus 430>

A refrigerant circuit (corresponding to the flow switching circuit of the present invention) of the refrigeration cycle apparatus 430 includes the compressor 1, the first six-way valve 2*a*, the second six-way valve 2*b*, the outdoor heat exchanger 4, the expansion valve 5, and the indoor heat exchanger 6, similarly to the refrigeration cycle apparatus 400. The compressor 1, the first six-way valve 2*a*, the outdoor heat exchanger 4, and the expansion valve 5 are housed in the outdoor unit 110. On the other hand, the second six-way valve 2*b* and the indoor heat exchanger 6 are housed in the indoor unit 120.

<Operation of Refrigeration Cycle Apparatus 430>

Next, an operation of the refrigeration cycle apparatus 430 will be described. The refrigeration cycle apparatus 430 can achieve the cooling operation and the heating operation by switching the flow paths of the first six-way valve 2*a* and the second six-way valve 2*b*.

In the refrigerant circuit during the cooling operation, the refrigeration cycle is formed in the state in which the flow paths of the first six-way valve 2*a* and the second six-way valve 2*b* are switched to solid lines illustrated in FIG. 22. In the case of the cooling operation, the refrigerant sent out from the compressor 1 flows through the first six-way valve 2*a*, the outdoor heat exchanger 4, the expansion valve 5, the first six-way valve 2*a*, and the second six-way valve 2*b*, and is branched at the branching point 15*a*. One stream of the branched refrigerant passes from the check valve 15 through the first heat exchange unit 6*a* and the second heat exchange unit 6*b*, and the second six-way valve 2*b*, and is sucked by the compressor 1. In addition, the other stream of the branched refrigerant passes through the third heat exchange unit 6*c* and the first six-way valve 2*a*, and is sucked by the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the first six-way valve 2*a* and the second six-way valve 2*b* are switched to broken lines illustrated in FIG. 22. In the case of the heating operation, the refrigerant sent out from the compressor 1 flows in the order of the first six-way valve 2*a*, the second six-way valve 2*b*, the first heat exchange unit 6*a* and the second heat exchange unit 6*b*, the second six-way valve 2*b*, the third heat exchange unit 6*c*, the first six-way valve 2*a*, the expansion valve 5, the outdoor heat exchanger 4, the first six-way valve 2*a*, and the compressor 1. At the time, the indoor heat exchanger 6 acts as a condenser, and the outdoor heat exchanger 4 acts as an evaporator.

By attaining such a refrigerant circuit, the inflow direction of the refrigerant to each path of the indoor heat exchanger 6 becomes the same in the case of the cooling operation and in the case of the heating operation.

<Effects>

In the refrigeration cycle apparatus 430 according to the modification 3 of Embodiment 2, the inflow direction of the refrigerant to the indoor heat exchanger 6 becomes the same in the case of the cooling operation and in the case of the heating operation, so that, in the indoor heat exchanger 6, similar effects as the outdoor heat exchanger 4 of the refrigeration cycle apparatus 400 according to Embodiment 2 described above can be obtained.

[Modification 4 of Refrigeration Cycle Apparatus 400]

Figure 23:
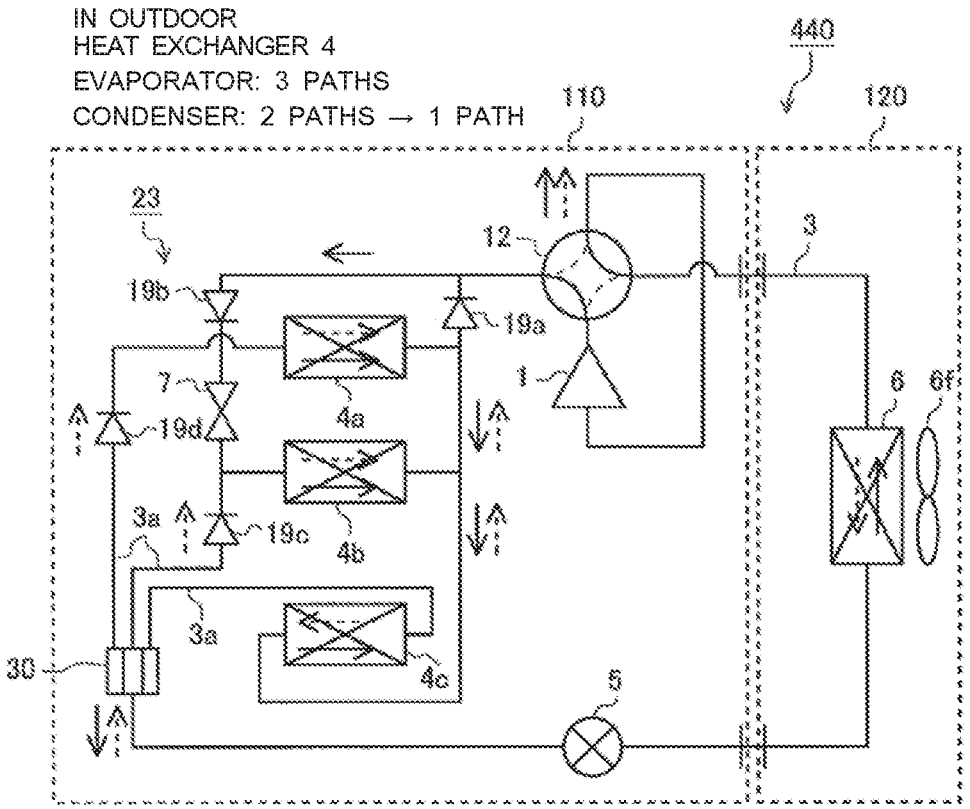
FIG. 23 is a configuration diagram illustrating a modification 4 of the refrigeration cycle apparatus 400 according to Embodiment 2.

FIG. 23 is a configuration diagram illustrating a modification 4 of the refrigeration cycle apparatus 400 according to Embodiment 2.

A refrigeration cycle apparatus 440 according to the modification 4 is different from the refrigeration cycle apparatus 400 according to Embodiment 2 at the point that a distributor 30 configured to uniformly distribute the refrigerant to the individual paths of the outdoor heat exchanger 4 acting as an evaporator during the heating operation is provided.

<Configuration of Refrigeration Cycle Apparatus 440>

A refrigerant circuit (corresponding to the flow switching circuit of the present invention) of the refrigeration cycle apparatus 440 includes the compressor 1, the four-way valve 12, the outdoor heat exchanger 4, the expansion valve 5, and the indoor heat exchanger 6. In addition, as a path switching circuit 23, a circuit in which a first check valve 19*a*, a second check valve 19*b*, a third check valve 19*c*, a fourth check valve 19*d*, the distributor 30, and an on-off valve 7 are combined is provided. Refrigerant pipes connected from the distributor 30 to the individual first heat exchange unit 4*a*, second heat exchange unit 4*b*, and third heat exchange unit 4*c* of the outdoor heat exchanger 4 are capillary tubes 3*a* of a diameter narrower than that of each of the refrigerant pipes 3.

The compressor 1, the outdoor heat exchanger 4, the expansion valve 5, and the path switching circuit 23 are housed in the outdoor unit 110. On the other hand, the indoor heat exchanger 6 is housed in the indoor unit 120.

<Operation of Refrigeration Cycle Apparatus 440>

Next, an operation of the refrigeration cycle apparatus 440 will be described. The refrigeration cycle apparatus 440 can achieve the cooling operation and the heating operation by switching the flow paths of the four-way valve 12.

In the refrigerant circuit during the cooling operation, the refrigeration cycle is formed in the state in which the flow paths of the four-way valve 12 are switched to solid lines illustrated in FIG. 23 and the on-off valve 7 is opened. In the case of the cooling operation, the refrigerant sent out from the compressor 1 flows in the order of the second check valve 19*b*, the first heat exchange unit 4*a* and the second heat exchange unit 4*b*, the third heat exchange unit 4*c*, the distributor 30, the expansion valve 5, the indoor heat exchanger 6, the four-way valve 12, and the compressor 1. At the time, the indoor heat exchanger 6 acts as an evaporator, and the outdoor heat exchanger 4 acts as a condenser.

On the other hand, in the refrigerant circuit during the heating operation, the refrigeration cycle is formed in the state in which the flow paths of the four-way valve 12 are switched to broken lines illustrated in FIG. 23 and the on-off valve 7 is closed. In the case of the heating operation, the refrigerant sent out from the compressor 1 flows through the four-way valve 12, the indoor heat exchanger 6, and the expansion valve 5, is branched at the distributor 30, and flows into the first heat exchange unit 4*a*, the second heat exchange unit 4*b*, and the third heat exchange unit 4*c*. Subsequently, the refrigerant from the three heat exchangers merges at the first check valve 19*a*, and is sucked by the compressor 1 through the four-way valve 12. At the time, the indoor heat exchanger 6 acts as a condenser, and the outdoor heat exchanger 4 acts as an evaporator.

By attaining such a refrigerant circuit, the number of the paths is reduced from two paths to one path in the outdoor heat exchanger 4 in the case of the cooling operation, and the refrigerant flows into three paths in parallel in the outdoor heat exchanger 4 in the case of the heating operation.

<Effects>

In the refrigeration cycle apparatus 440 according to the modification 4 of Embodiment 2, in addition to the effects of the refrigeration cycle apparatus 400 according to Embodiment 2, the refrigerant flowing into the individual paths of the outdoor heat exchanger 4 is uniformly distributed by the distributor 30. Consequently, heat exchange performance of the outdoor heat exchanger 4 acting as an evaporator is improved.

REFERENCE SIGNS LIST

1 compressor 2 six-way valve 2A rotary unit 2B substrate unit 2*a* first six-way valve 2*b* second six-way valve 3 refrigerant pipe 3*a* capillary tube 4 outdoor heat exchanger 4*a* first heat exchange unit 4*b* second heat exchange unit 4*c* third heat exchange unit 4*f* outdoor fan 5 expansion valve 5*a* first expansion valve 5*b* second expansion valve 6 indoor heat exchanger 6*a* first heat exchange unit 6*b* second heat exchange unit 6*c* third heat exchange unit 6*f* indoor fan 7 on-off valve 7*a* first on-off valve 7*b* second on-off valve 7*c* third on-off valve 8*a* first three-way valve 8*b* second three-way valve 9 four-way valve 10 path switching circuit 10*a* first flow path 10*b* second flow path 10*c* third flow path 11 eight-way valve 12 four-way valve 12*a* first four-way valve 12*b* second four-way valve 13 first check valve bridge circuit 13*a* first check valve 13*b* second check valve 13*c* third check valve 13*d* fourth check valve 14 second check valve bridge circuit 14*a* first check valve 14*b* second check valve 14*c* third check valve 14*d* fourth check valve 15 check valve 15*a* branching point 16 receiver tank degassing valve 17*a* degassing pipe 18 check valve 18*a* degassing pipe 19*a* first check valve 19*b* second check valve 19*c* third check valve 19*d* fourth check valve 20 path switching circuit 20*a* first flow path 20*b* second flow path 20*c* third flow path 21 path switching circuit 21*a* first flow path 21*b* second flow path 21*c* third flow path 22 path switching circuit 23 path switching circuit 30 distributor 100 refrigeration cycle apparatus 110 outdoor unit 120 indoor unit 200 refrigeration cycle apparatus 210, 220, 230, 240, 250, 260, 270, 280, 290, 300, 400, 410, 420, 430, 440 refrigeration cycle apparatus

The invention claimed is:

1. A refrigeration cycle apparatus, comprising:

a heat exchanger;

a fan configured to supply air for heat exchange to the heat exchanger; and a flow switching circuit configured to switch the heat exchanger to act as any one of an evaporator and a condenser, the flow switching circuit being configured to allow refrigerant to flow into the heat exchanger in a same direction both in a case where the heat exchanger acts as an evaporator and in a case where the heat exchanger acts as a condenser, the heat exchanger including a path switching circuit including a plurality of paths, the path switching circuit being configured to switch an order of the plurality of paths through which refrigerant flows between an order of the plurality of paths in the case where the heat exchanger acts as an evaporator and an other order of the plurality of paths in the case where the heat exchanger acts as a condenser, the path switching circuit being configured to switch directions of refrigerant flowing through the plurality of paths so that, in at least one case of (a) the case where the heat exchanger acts as an evaporator and (b) the case where the heat exchanger acts as a condenser, the heat exchanger has (i) one of the plurality of paths through which refrigerant flows opposite to a direction of the air blown from the fan, and (ii) an other of the plurality of paths through which refrigerant flows in parallel to the direction of the air blown from the fan.

2. The refrigeration cycle apparatus of claim 1, wherein the path switching circuit includes a first path having a first number of paths and a second path having a second number of paths smaller than the first number of paths of the first path, wherein the path switching circuit is switched to allow refrigerant to flow in order from the first path to the second path in the case where the heat exchanger acts as a condenser, and wherein the path switching circuit is switched to allow refrigerant to flow in parallel to the first path and the second path in the case where the heat exchanger acts as an evaporator.

3. The refrigeration cycle apparatus of claim 2, wherein the heat exchanger is constituted of a first heat exchange unit, a second heat exchange unit, and a third heat exchange unit, and wherein the first heat exchange unit and the second heat exchange unit are connected to the first path, and the third heat exchange unit is connected to the second path.

4. The refrigeration cycle apparatus of claim 1, wherein the path switching circuit includes a first path having a first number of paths and a second path having a second number of paths smaller than the first number of paths of the first path, wherein the path switching circuit is switched to allow refrigerant to flow in order from the second path to the first path in the case where the heat exchanger acts as an evaporator, and wherein the path switching circuit is switched to allow refrigerant to flow in order from the first path to the second path in the case where the heat exchanger acts as a condenser.

5. The refrigeration cycle apparatus of claim 4, wherein the second path is positioned below the first path in a vertical direction.

6. The refrigeration cycle apparatus of claim 1, wherein the flow switching circuit includes one six-way valve.

7. The refrigeration cycle apparatus of claim 1, wherein the flow switching circuit includes one eight-way valve.

8. The refrigeration cycle apparatus of claim 1, wherein the flow switching circuit includes two four-way valves.

9. The refrigeration cycle apparatus of claim 1, wherein the flow switching circuit includes a check valve bridge circuit constituted of four check valves.

10. The refrigeration cycle apparatus of claim 1, wherein the flow switching circuit includes two six-way valves.

11. The refrigeration cycle apparatus of claim 1, wherein the flow switching circuit includes a receiver tank configured to store liquid refrigerant.

12. The refrigeration cycle apparatus of claim 11, wherein the flow switching circuit includes a degassing pipe connected to a low-pressure refrigerant pipe from the receiver tank.

13. The refrigeration cycle apparatus of claim 1, wherein a zeotropic refrigerant mixture is enclosed as working refrigerant.

14. The refrigeration cycle apparatus of claim 1, wherein an azeotropic refrigerant mixture is enclosed as working refrigerant.

* * * * *